United States Patent [19]

Castner et al.

[11] Patent Number: 4,649,493

[45] **Date of Patent: * Mar. 10, 1987**

[54] TUBE EXPANSION APPARATUS

[75] Inventors: Raymond P. Castner, Monroeville; David F. Olechovsky, North Huntingdon, both of Pa.; Philip S. Brown, Brandon, Fla.; Susanta Sinha, Penn Township, Westmoreland County, Pa.; Harold T. Keller, Baldwin Borough, Pa.; Wenche W. Cheng, Monroeville, Pa.

[73] Assignee: Westinghouse Electric Corp., Pittsburgh, Pa.

[ * ] Notice: The portion of the term of this patent subsequent to Mar. 10, 2004 has been disclaimed.

[21] Appl. No.: 567,104

[22] Filed: Dec. 30, 1983

[51] Int. Cl.[4] ..... G06F 15/46; B23P 15/26

[52] U.S. Cl. ..... 364/472; 29/157.3 C; 29/421 R; 29/523; 72/58; 72/61; 72/20; 364/558; 376/286

[58] Field of Search ..... 364/472, 505, 506, 507, 364/558; 29/421 R, 157.3 C, 157.4, 523, 234, 723, 727; 72/54, 56, 58, 59, 61, 62, 370, 20, 21; 376/245, 247, 249, 285, 286, 305

[56] References Cited

U.S. PATENT DOCUMENTS

| | | | |
|---|---|---|---|
| Re. 30,802 | 11/1981 | Rogers, Jr. | 29/421 R |
| 4,164,807 | 8/1979 | King, Jr. | 72/370 X |
| 4,195,390 | 4/1980 | Amen | 29/421 R |
| 4,210,991 | 7/1980 | Cooper, Jr. | 29/421 R |
| 4,364,251 | 12/1982 | Nishihara et al. | 72/58 |
| 4,407,150 | 10/1983 | Kelly | 72/61 |
| 4,506,423 | 3/1985 | Nakamura et al. | 29/421 R X |
| 4,513,497 | 4/1985 | Finch | 72/54 X |

FOREIGN PATENT DOCUMENTS

| | | |
|---|---|---|
| 004864A1 | 10/1979 | European Pat. Off. . |
| 005101A2 | 6/1982 | European Pat. Off. . |
| 066871A1 | 12/1982 | European Pat. Off. . |
| 2069387 | 8/1981 | United Kingdom . |

*Primary Examiner*—Joseph Ruggiero
*Attorney, Agent, or Firm*—L. A. DePaul

[57] ABSTRACT

An apparatus for expanding a tube against the walls of a circumscribing bore, or a sleeve within a tube to effect an interference joint therebetween, is described herein. The tube expansion apparatus generally comprises a fluid mandrel connected to a hydraulic expansion unit for applying a radially expansive force to the tube or sleeve, and a control circuit electrically connected to the expansion unit and fluidly connected to the mandrel for sensing fluctuations in the pressure of the fluid discharged from the mandrel during the elastic and plastic deformation of the tube or sleeve during the expansion process, computing a final swaging pressure on the basis of these pressure fluctuations, and deactuating the hydraulic expansion unit when this final swaging pressure is attained within the tube or sleeve. The invention is particularly adapted for minimizing or eliminating the clearance between the heat exchange tubes of a nuclear reactor, and the baffle plate bores through which they extend. The invention may also be used to generate interference joints between such heat exchange tubes, and a reinforcing sleeve inserted therein.

27 Claims, 17 Drawing Figures

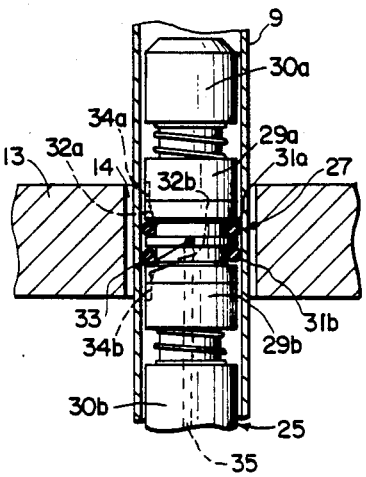
FIG. 2
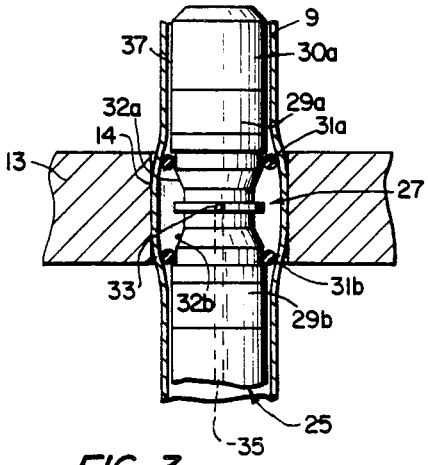
FIG. 3
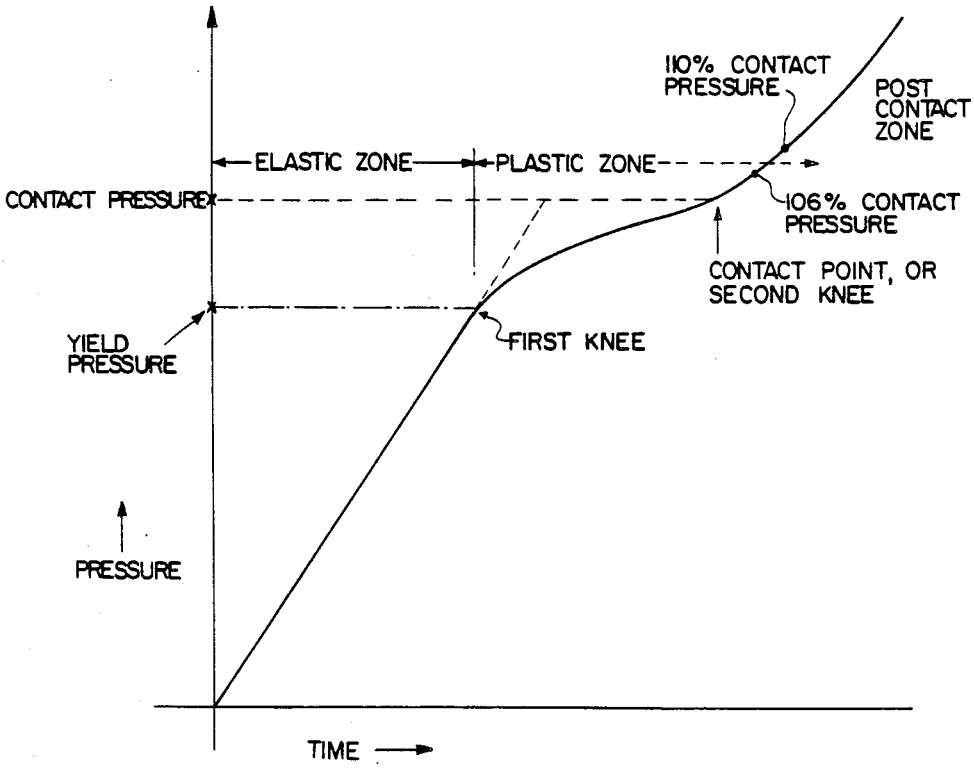
FIG. 4 TUBE EXPANSION WITHIN A BORE OF A BAFFLE PLATE

TUBE EXPANSION APPARATUS

BACKGROUND OF THE INVENTION

1. Field of the Invention

This invention relates to devices for hydraulically expanding a conduit surrounded by a structure in order to bring the conduit into contact with, or engagement with, the surrounding structure. It finds particular application in reducing the clearance between heat exchange tubes and baffle plates in nuclear steam generators, and in joining reinforcing sleeves on the inside walls of these tubes by producing interference joints therebetween.

2. Description of the Prior Art

Devices for hydraulically expanding plastically-deformable conduits are known in the prior art. Such devices generally comprise a hydraulic expansion unit, and a fluid mandrel connected thereto which is capable of applying enough hydraulic pressure to the inside of an axial section of the conduit to plastically deform the conduit. Such hydraulic expansion devices are frequently used to effect repairs or maintenance on the heat exchanger tubes of a nuclear steam generator. In such generators, it is generally difficult to gain access to the outside tube surfaces due to the density in which they are arranged, and the limited access space afforded by the few water inlets and outlets in the walls of these generators. Therefore, the most convenient way to gain access to these tubes is through their inlet ports which are present in the tubesheet dividing the primary and secondary sides of the steam generator. When the walls of these tubes have been weakened or pitted by corrosion or excessive heat and fluid currents, such hydraulic expansion devices are frequently used to join cylindrical sleeves to the insides of these tubes. When such devices are used for sleeving, a cylindrical reinforcing sleeve is first frictionally engaged over the head of the fluid mandrel. Next, the mandrel and sleeve are inserted into the mouth of the tube to the repaired. The mandrel and sleeve are then positioned along the axial section of the tube in need of repair. The hydraulic expansion unit is actuated, and the mandrel head applies sufficient hydraulic pressure to both the sleeve and the surrounding tube to plastically expand both, thereby creating an interference joint therebetween. The end result is that the hydraulic expansion device joins a sleeve across the corroded or pitted portion of the tube which reinforces the tube and shunts the flow of water away from the weakened walls of the tube and through the walls of the sleeve. Apart from a sleeving operation, such a device could also be used to effect an expansion directly on a heat exchanger tube incident to other maintenance processes.

Unfortunately, such prior art hydraulic expansion devices are not without shortcomings. For example, such devices do not consider the specific elastic and plastic properties of the tubes and sleeves being expanded. Instead, these devices attempt to create interference fittings for other expansions on the basis of a pre-selected "average" of the elastic and plastic properties of the tubes and sleeves being expanded. Hence, it is difficult to obtain truly uniform expansions with these devices. Since mechanical reliability is of paramount importance in a nuclear steam generator, such non-uniformity, and the uncertainty of results which attends it, is undesirable.

Clearly, a need exists for a hydraulic expansion device which is capable of producing highly uniform expansions in order to maximize the mechanical reliability of the system as a whole. Ideally, such a device should take into account the specific plastic and elastic properties of the tubes being expanded in determining a final swaging pressure so that a near-perfect expansion is possible in each tube.

SUMMARY OF THE INVENTION

In its broadest sense, the apparatus of the invention comprises an expansive force means for generating a radially expansive force within a conduit, and a control means operatively connected to the expansive force means for controlling the expansive force applied to the conduit. Generally speaking, the control means includes a sensing means for sensing the value of a variable which varies upon contact between said conduit and said structure, and a computing circuit for computing a final engagement value of said force on the basis of a post-contact value of this variable. When the expansive force means is a hydraulic expansion unit which continuously increases the hydraulic pressure in the conduit over time, the sensing means may include a pressure transducer for continuously determining the fluid pressure within the conduit. The invention may be used to minimize or eliminate the clearance between a plastically deformable tube and the walls of a relatively non-plastically deformable structure circumscribing the tube by identifying the inflection point in the pressure function associated with contact between the tube and the structure, and then raising the expansive pressure a preselected percentage over the value of the contact pressure in order to compensate for elastic contraction of the conduit, which occurs when the pressure is relieved from the conduit. The apparatus of the invention may also be used to form an interference fitting between a plastically deformable sleeve concentrically disposed within a plastically deformable conduit. In this case, the computing circuit of the control means may generate a line function originating on a point just before the inflection point in the pressure function associated with the commencement of plastic deformation in the tube. The computing circuit may determine the slope of this line function by computing the slope of the point located just before the aforesaid inflection point, and substracting about 7° from the angle thereof.

The control means may further include a high frequency filter circuit electrically connected between the pressure transducer and the computer circuit, as well as a switching circuit electrically connected between the output of the computing circuit for deactuating the hydraulic expansion unit. Additionally, the control means may include an interface logic circuit connected between the computing circuit and the switching circuit for controlling the action of the switching circuit and deactuating the hydraulic expansion unit upon any number of preselected malfunction conditions.

Finally, the control means may include a reset circuit electrically connected to the computing circuit for resetting the computing circuit.

BRIEF DESCRIPTION OF THE SEVERAL FIGURES

FIG. 2 is a partial cross-sectional view of one of the heat exchanger tubes shown in FIG. 1, illustrating both the clearance which typically exists between a heat exchange tube and its baffle plate bore, as well as the fluid mandrel of the invention;

FIG. 3 illustrates how the fluid mandrel of the invention reduces the clearance between the tube and the baffle plate bore illustrated in FIG. 2;

FIG. 4 illustrates how the pressure admitted into the tube of FIG. 3 varies as a function of time;

Figure 11A:
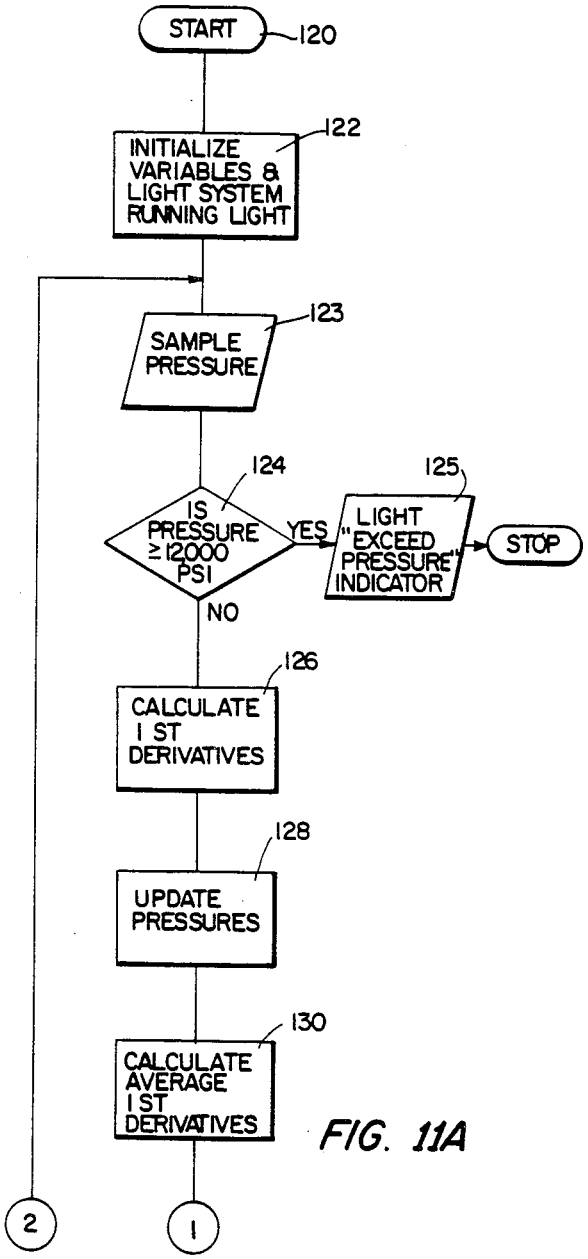
Figure 11B:
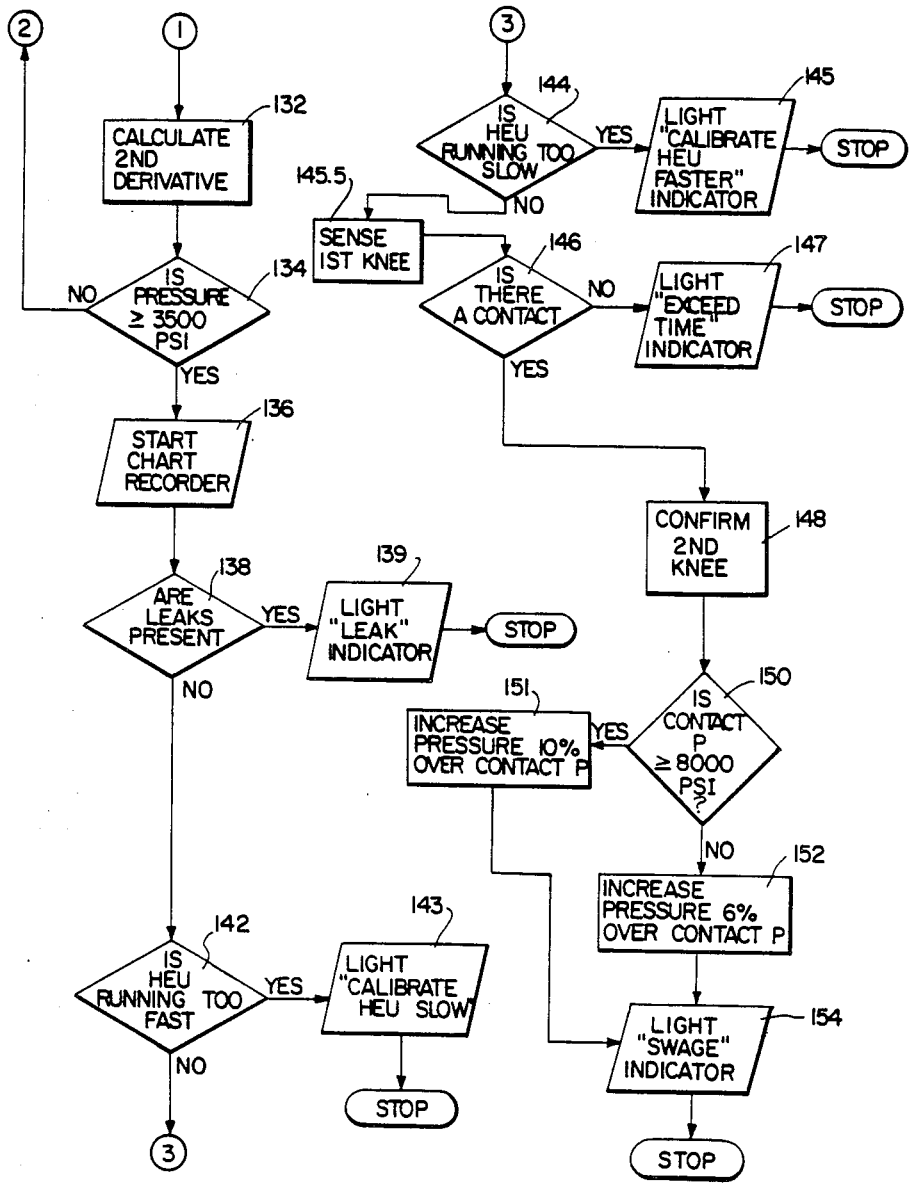
Figure 12A:
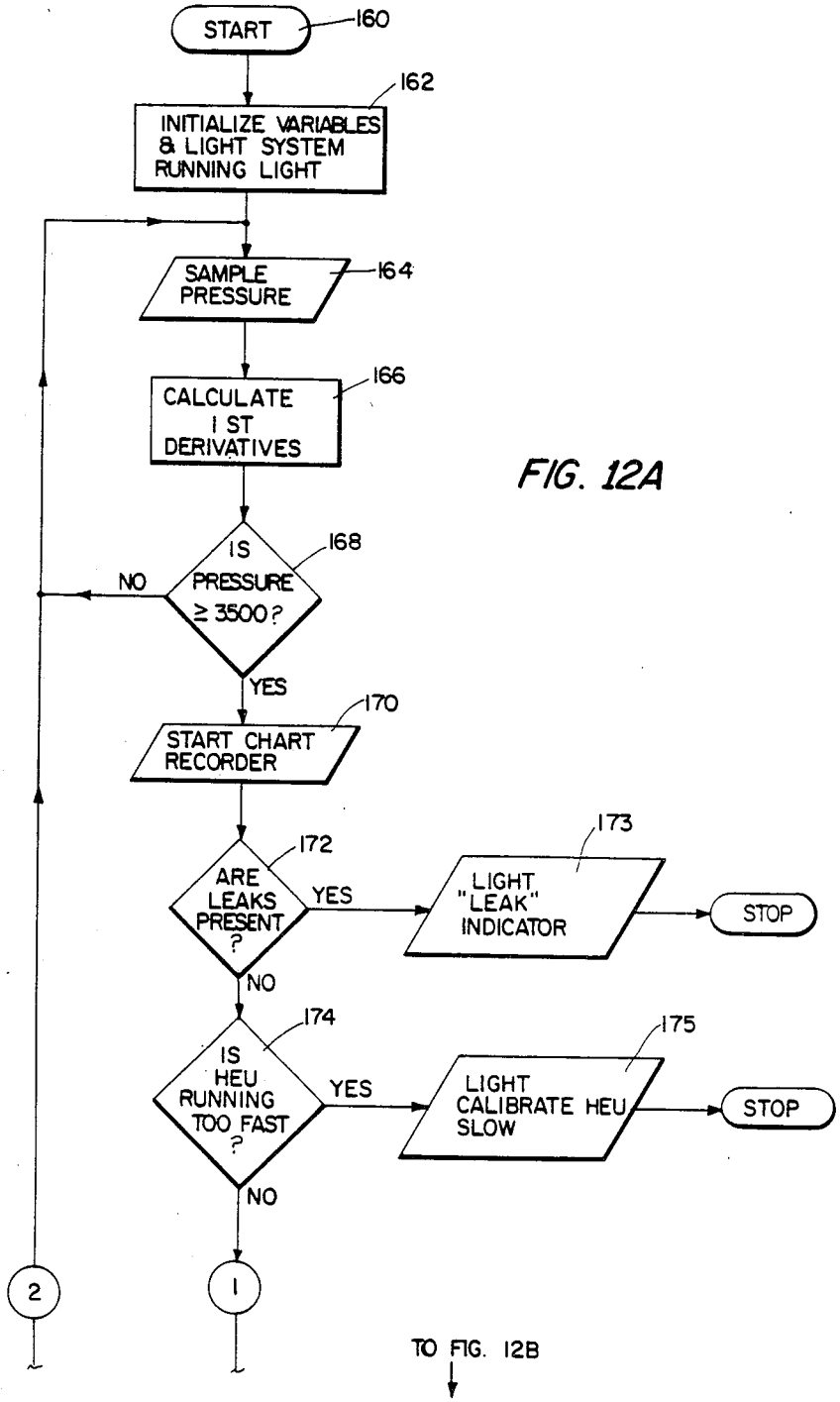
Figure 12B:
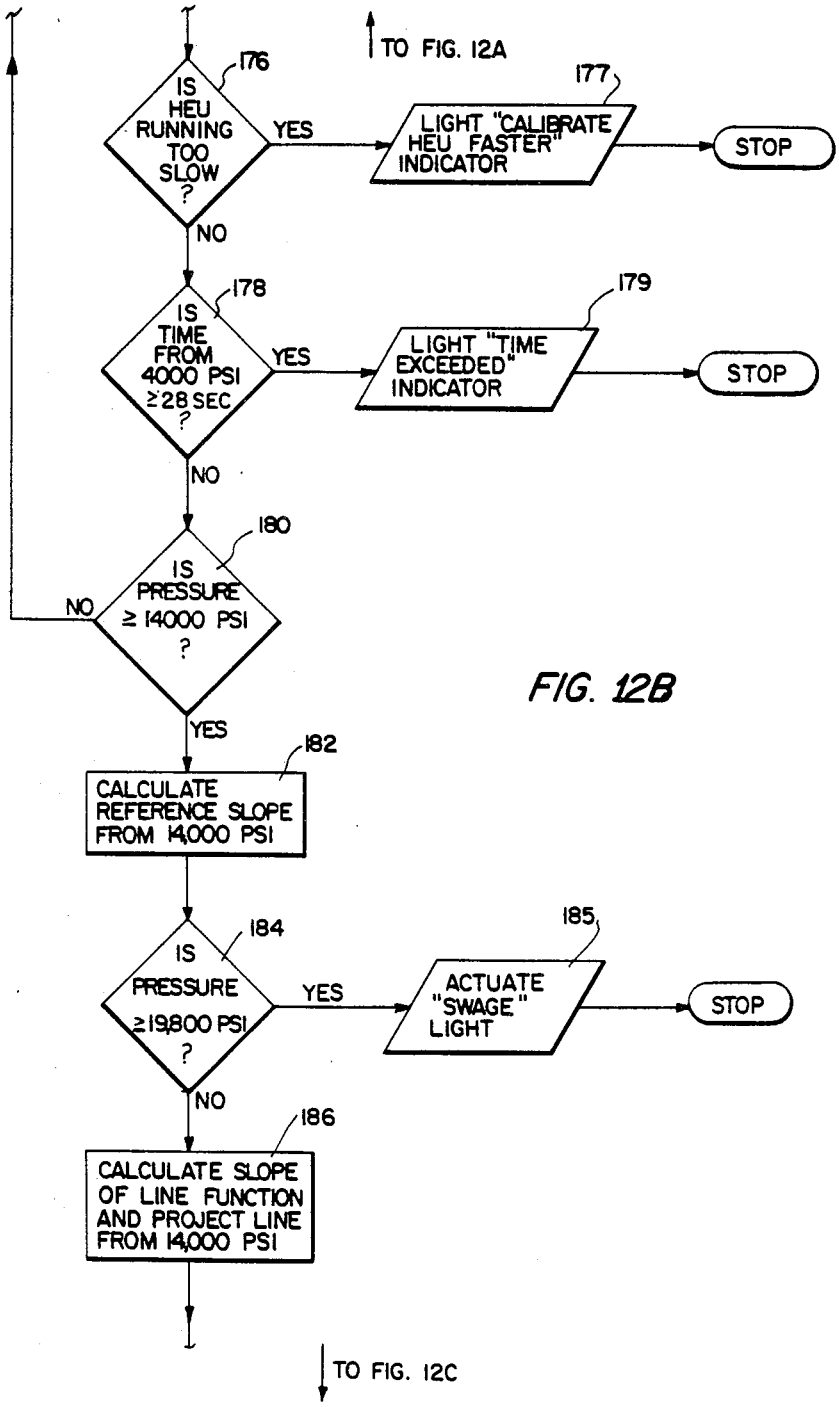
Figure 12C:
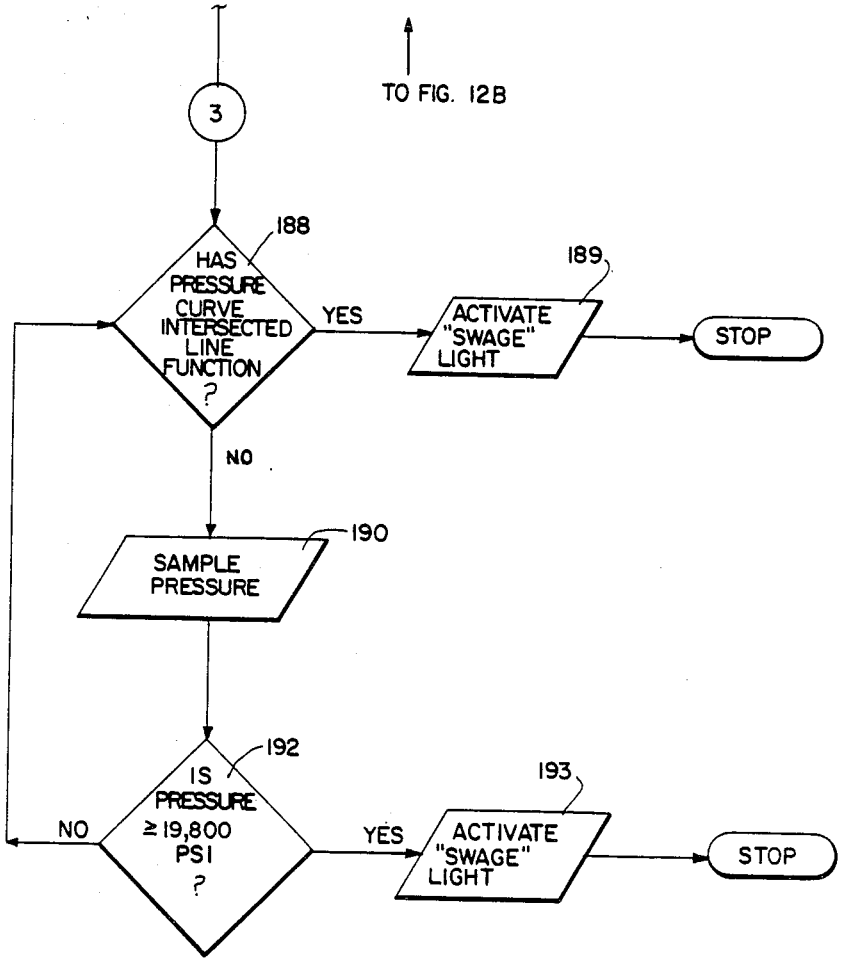

FIGS. 11A and 11B are a flow chart illustrating the process of the invention as applied to reducing the clearance between heat exchanger tubes and baffle plates, as well as one of the programs of the computer of the control circuit of the invention, and FIGS. 12A, 12B and 12C are a flow chart illustrating the process of the invention as applied to a sleeving operation, as well as another program of the computer.

DETAILED DESCRIPTION OF THE PREFERRED EMBODIMENT

Overview of the Purpose, Structure and Operation of the Invention

Figure 5:
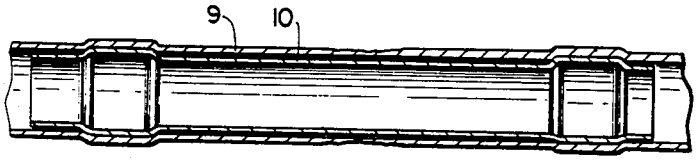
FIG. 5 illustrates how the invention may be used to achieve an interference fitting between a heat exchanger tube and a reinforcement sleeve inserted therein.

With reference now to FIGS. 1 through 5, wherein like numerals designate like components throughout the several figures, both the apparatus and process of the invention are particularly adapted for repairing sections of the U-shaped tubes 9 in a steam generator 1 used in a nuclear power plant which become weakened by mechanical shock and corrosion. Specifically, the invention may be used to eliminate or at least reduce the shock-causing clearance between these tubes 9 and the bores 14 in the horizontally disposed baffle plates 13 located in the lower portion of the generator 1. Since water currents flowing through the genereator 1 tend to rattle the U-shaped tubes back and forth within the bores 14, these clearances give the tubes 9 sufficient play to strike and become damaged by the walls of the bores 14. Both the apparatus and process of the invention may be used to eliminate this problem by a controlled expansion of the tubes 9 within the bores 14, as is best seen in FIG. 3. Additionally, the invention may be used to join a reinforcing sleeve 10 across a corroded section of a tube 9 by expanding both the sleeve 10 and the tube 9 in two areas to produce an interference fitting therebetween, as is best illustrated in FIG. 5. Such corrosion often occurs near the tubesheet 7 of the steam generator 1 where chemically active sludge deposits are apt to accumulate. The sleeve 10, when joined inside the tube 9 as shown, effectively shunts the flow of water away from the corroded portions of the walls of the tube 9 and through the sleeve 10.

Figure 1:
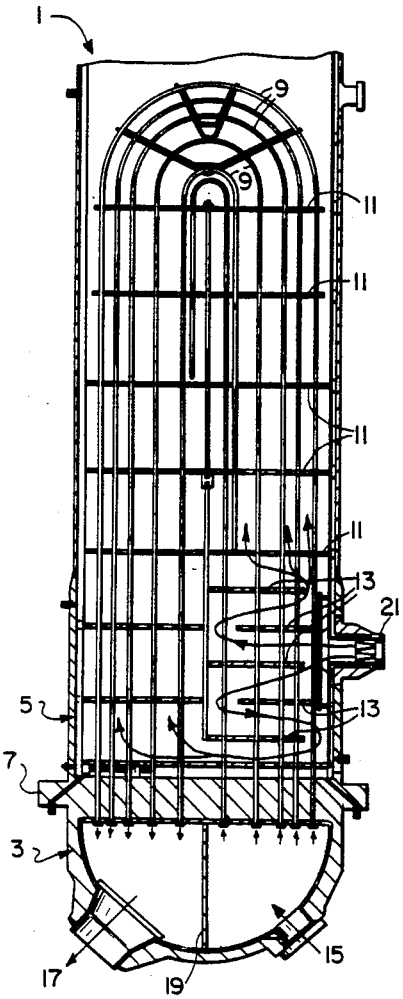
FIG. 1 is a cross-sectional view of a nuclear power plant steam generator, illustrating how the heat exchanger tubes pass through the tubesheet and baffle plates of the generator.

A clearer understanding of both the purpose and operation of the invention may be had by a closer examination of the structure of the steam generator 1 illustrated in FIG. 1. This steam generator 1 generally includes a primary side 3 through which hot, radioactive water from the reactor core (not shown) is admitted into the U-shaped tubes 9, and a secondary side 5 which houses the U-shaped tubes 9 and directs a flow of non-radioactive water through them from secondary inlet 21. The generator 1 exchanges heat from radioactive water flowing through the primary side 3 to non-radioactive water flowing through the secondary side. The primary side 3 and the secondary side 5 of the generator 1 are separated by a relatively thick tube sheet 7 as indicated. The primary side 3 of the generator 1 is divided by a vertical divider plate 19 into an inlet side having a primary inlet 15, and an outlet side having a primary outlet 17. Hot, radioactive water from the reactor core is admitted under pressure into the primary inlet 15, and from there into the inlet ports of the U-shaped tubes 9. This water flows upwardly through the right legs of the U-shaped tubes 9 and around to the left-hand legs of these tubes, and out through the primary outlet 17 of the steam generator 1 as indicated. The heat from this radioactive water is exchanged into a flow of non-radioactive water which enters the secondary side of the steam generator 1 through secondary inlet 21 and exits the generator 1 through a secondary outlet (not shown).

To facilitate heat exchange between this non-radioactive water and the radioactive water flowing through U-shaped tubes 9, a plurality of horizontally disposed baffle plates 13 are mounted in the lower, right-hand portion of the secondary side 5 of the steam generator 1. These baffle plates 13 cause the stream of water admitted into inlet 21 to wind back and forth between the U-shaped tubes 9 in a serpentine pattern as indicated. Such a tortuous flow path enhances the thermal contact between the radioactive water flowing through the tubes 9 and the non-radioactive water flowing through the secondary inlet 21 and outlet of the generator 1. However, as previously mentioned, the fluid currents associated with the inflow of water from inlet 21 cause the tubes 9 to resonate and rattle against the walls of the bores 14 through which they extend. The resultant mechanical shock weakens the walls of the tubes 9.

Another problem area in the tubes 9 of generator 1 is the region just above the tubesheet 7. Here, considerable corrosion in the outside tube walls may occur from constant exposure to the chemically active sludge and sediments which settle and accumulate on top of the tubesheet 7, and the heat from the inflow of radioactive water which is essentially uncooled at this region. Such corrosion may weaken the walls of the conduits 9 in this region to the extent that they rupture, thereby radioactively contaminating the non-radioactive water flowing through the secondary side 5 of the generator 1.

As will presently be seen, the invention solves the first problem by expanding the tubes 9 in the vicinity of their respective baffle sheet bores 14, and the second problem by sleeving the corroded portions of the tubes 9 with expanded interference joints.

A.

General Description of the Invention as Applied to the Baffle Plate Problem

With specific reference now to FIG. 2, each one of the U-shaped tubes 9 extends through a bore 14 located in each one of the horizontally disposed baffle plates 13. In many generators 1, the U-shaped tube 9 is formed from an Inconel type alloy, and has an outer diameter of 0.750 in. and a wall thickness of 0.043 in. The baffle plates 13 are approximately 0.750 in. thick, and the bores 14 are typically on the order of 0.769 in. in diameter. Therefore, the diametrical clearance between the tube 9 and the bore 14 is usually at least 0.019 in., and may be as high as 0.045 in. As previously described, this gap between the U-shaped tubes 9 and the bores 14 in the baffle plates 13, coupled with the tendency of the tubes 9 to rattle from side to side within these bores 14 when struck by the stream of water admitted into the steam generator 1 from the secondary inlet 21, causes a significant amount of vibration to the tubes 9 in the vicinity of the bores 14 of the baffle plates 13. Such vibration ultimately weakens the tubes 9 in the vicinity of the bores 14, and may induce corrosion in the surfaces of the tubes 9 in this area.

Turning now to FIGS. 3 and 4, both the apparatus and process of the invention solve this problem by expanding the walls of the tubes 9 in the vicinity of the bores 14 so that the final tube-to-baffle plate clearance is no greater than 0.003 in. The invention accomplishes this result by means of a hydraulic expansion unit (HEU) 40 having a novel control circuit 50 which effects a controlled expansion of the U-shaped tubes 9 in the vicinity of their respective bores 14 by means of an improved fluid mandrel 25 (illustrated in FIGS. 7A and 7B). While a fluid mandrel is preferred, it should be noted that a mandrel utilizing a compressed elastomer may also be used. The fluid mandrel 25 of the invention includes a mandrel head 27 having a pair of annular shoulders 34*a*, 34*b* on either end for seating a pair of O-rings 31*a*, 31*b* in a fluid-tight seal against the walls of tube 9 when pressurized fluid is pumped through a fluid canal 35 in the mandrel body and out through an orifice 33 which is located between the O-rings. Fluid mandrel 25 also includes an eddy current probe assembly 36 mounted below the mandrel head 27 which allows the operator of the hydraulic expansion unit to position properly the mandrel head 27 in the section of the tube 9 circumscribed by the walls of the bore 14.

The general operation of the invention in reducing troublesome baffle plate clearance is illustrated in FIGS. 3 and 4. To prevent unwanted binding between the O-rings 31*a*, 31*b* of fluid mandrel 25 and the walls of tube 9, the interior of the tube 9 may first be cleaned with a rotary brush and swabbed with a lubricant, such as glycerin. The fluid mandrel 25 is then slid into the tube 9, and placed in proper position by means of eddy current probe assembly 37, which generates a signal informing the operator of the hydraulic expansion unit 40 when the coils 36.4*a*, 36.4*b* of the probe assembly 36 are precisely aligned along the upper and lower surfaces of the baffle plate 13. Since the operator knows the precise distance "X" between the center of the coils 36.4*a*, 36.4*b* and the center of the mandrel head 27, he knows that the O-rings 31*a*, 31*b* of the mandrel head 27 will be properly positioned when the mandrel head 27 is pulled down distance "X". After the operator is satisfied that the mandrel head 27 is properly positioned within the tube 9, he actuates the hydraulic expansion unit 40. This in turn causes a flow of high-pressure hydraulic fluid to flow through the centrally-disposed canal 35 of the mandrel 25, and out of the fluid orifice 33. The pressurized fluid pushes the resilient O-rings 31*a*, 31*b* out of their recesses 31.3*a*, 31.1*b*, rolls them in opposite directions up annular ramps 32*a*, 32*b* and into seating engagement with their respective shoulders 34*a*, 34*b*, thereby creating a pressure-tight seal between the pressurized fluid discharged from orifice 33 and the interior walls of tube 9. The pressure of the hydraulic fluid flowing out of the fluid orifice 33 continuously increases over time, and elastically bulges the walls of the tube 9 outwardly toward the walls of the bore 14.

If the pressure of the hydraulic fluid were released at any point within the "elastic zone" designated on the graph of FIG. 4, the Inconel tube would merely spring back into its original shape. However, if the pressure of the hydraulic fluid is increased into the "plastic zone" illustrated in the graph of FIG. 4, a permanent, gap-closing bulge begins to be created in the tube 9. It is important to note that the transition from the elastic zone into the plastic zone of the pressure/time curve is characterized by a first inflection point or "knee" located at the yield pressure. If the pressure is increased still more in the plastic zone of the graph, the expanded zone in the tube 9 begins to contact the walls of the bore 14 of the baffle plate 13. Such contact is characterized by a second inflection point or knee on the pressure/-time curve. If the pressure is increased still further into the "post-contact zone" of the graph, the bulge in tube 9 eventually engages substantially the entire area of the bore 14 in the plate 13, and causes the tube 9 to deform into the expanded shape illustrated in FIG. 3. As will be described in more detail hereinafter, in order to compensate for the elastic component of the metal which still exists in the plastic zone shown in the graph, the control circuit 50 of the invention raises the pressure in the tube 9 after full contact has been made by a predetermined percentage over the contact pressure so that the tube 9 assumes the gap-eliminating shape illustrated in FIG. 3 when the fluid pressure is relieved. The preferred embodiment of the invention is capable of safely and reliably closing gaps of a variety of widths between baffle plates and U-shaped Inconel tubes having substantially different metallurgical properties, as will be presently described.

B.

General Description of the Invention as Applied to Sleeving

Figure 6:
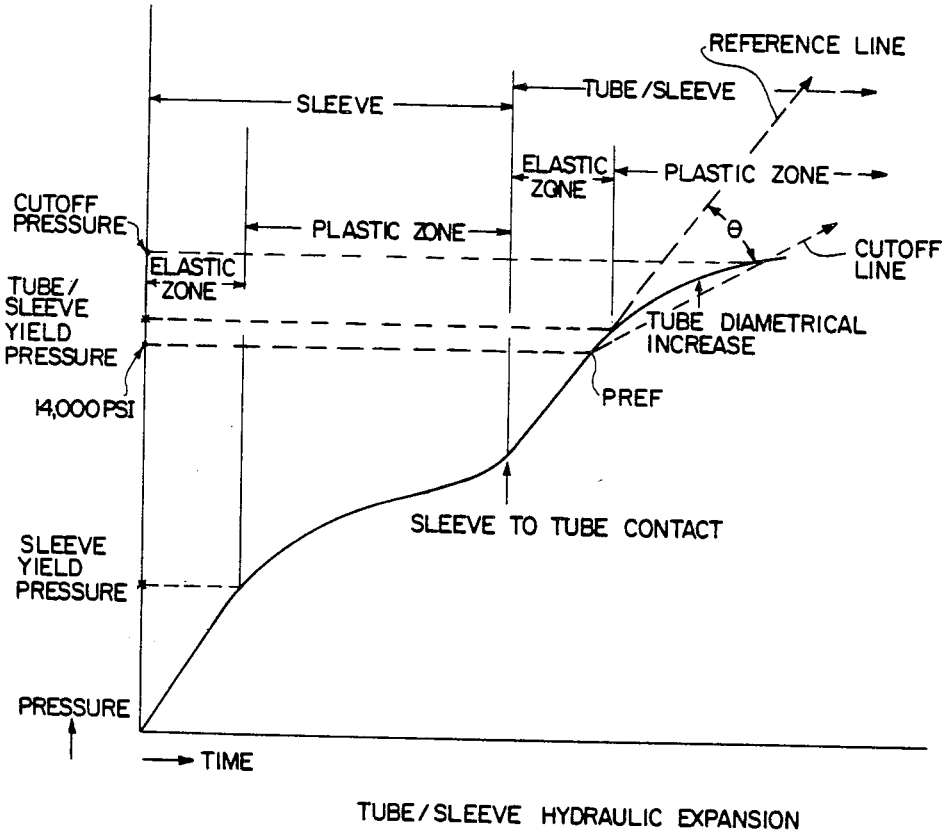
FIG. 6 illustrates how the pressure admitted into the sleeve/tube combination of FIG. 5 varies as a function of time.

With specific reference now to FIGS. 5 and 6, the invention may also be used to attach a sleeve 10 across a corroded portion of one of the U-shaped tubes 9 by expanding the sleeve 10 at either end in order to create an interference-type joint between the sleeve 10 and the tube 9. In the preferred embodiment, sleeve 10 is formed from an appropriately chosen Inconel-type stainless steel alloy. While the clearance between sleeve 10 and tube 9 is usually about 0.030 in., it can be anywhere from 0.25 in. to 0.35 in. Generally speaking, the fluid mandrel 25 of the hydraulic expansion unit 40 plastically expands both the sleeve 10 and the tube 9 in the shape indicated in FIG. 5 so that the flow of water through the tube 9 is shunted through the inside walls of the sleeve 10, and away from the inside walls of the tube 9.

In operation, a sleeve 10 is first slid over the head of a mandrel. When the sleeving is to be performed on the tubes 9 in the vicinity of the tubesheet 7, a mandrel such as that disclosed in U.S. Pat. No. 4,368,571 may be used. On the other hand, if the sleeving is to be performed across the bore of a baffle plate 13, the mandrel 25 disclosed herein is preferred since the eddy probe assembly 36 can be used to properly position the sleeve across the vicinity of the plate. In any event, the sleeve 10 and mandrel 25 are then inserted through the inlet of the tube 9 to be sleeved, and positioned across an axial portion of the tube 9 in which corrosion has been detected. Once the operator is confident that the sleeve 10 is properly positioned, he actuates the hydraulic expansion unit 40. Again, pressurized water flows out of the fluid orifice 33 of the mandrel head 27, and unseats the O-rings 31*a*, 31*b* out of their recesses 36.3*a*, 36.3*b*. The O-rings again roll up annular ramps 32*a*, 32*b* and seat against their respective shoulders 29*a*, 29*b*. The pressure of the hydraulic fluid flowing out of the fluid orifice 33 continuously increases over time, and elastically expands the walls of the sleeve 10 outwardly toward the walls of the tube 9. The pressure function bypasses the sleeve yield pressure indicated on the graph of FIG. 6, and enters into the "plastic zone" of the sleeve 10. Eventually, the plastically deformed sleeve 10 contacts the tube 9. Such contact is characterized by a second inflection point or knee in the pressure/time curve. At this point in the pressure function, the sleeve 10 is being plastically deformed, while the tube 9 is only being elastically deformed. If the pressure is increased past the elastic zone of the tube 9, the pressure function undergoes a third inflection point, which indicates that both the sleeve 10 and the tube 9 are being plastically deformed into an interference-type joint.

In order to create an interference-type joint which takes into consideration the specific sleeve/tube gap and the specific metallurgical properties of the tube 9 and sleeve 10, the control circuit 50 of the invention monitors a variable which is dependent upon the elastic and plastic properties of the sleeve/tube combination. Specifically, the control circuit 50 of the invention determines the location of the third inflection point of the pressure function, and projects a line function on the point in the pressure/time curve from a point immediately preceding that inflection point. Additionally, the control circuit 50 assigns a slope to this line function which is approximately 7° less than the slope of this point immediately preceding the third inflection point of the function. When the invention is applied to sleeving an Inconel tube in a Combustion Engineering type steam generator, the point of origin of the aforementioned line function is automatically chosen to be 14,000 psi. Applicants have found that the preceding, empirically-derived algorithm for computing a final swaging pressure yields consistently sound and uniform interference-type joints between sleeves 10 and tubes 9 having substantially different gaps and metallurgical properties. To perfect the interference joints, each of the hydraulically-created joints on either side of the sleeve 10 may be cold-rolled with a rolling tool in accordance with conventional sleeving techniques. When the sleeving operation is performed across a baffle plate 13, the eddy current probe assembly 36 of fluid mandrel 25 may conveniently be used to generate an electronic profile of the joint after the hydraulic pressure in the mandrel 25 is relieved by pushing the probe 36 above the top of the sleeve 10, and slowly pulling it the entire length through the sleeve 10. Such a profile is useful in confirming the soundness and location of the interference joints. The provision of an eddy current probe assembly 36 on the mandrel 25 in this instance is advantageous in at least two respects. First, it saves the operator both the time and trouble of completely sliding out the mandrel and then inserting a separate eddy probe back into the tube 9. Second, it spares the operator the increased exposure to radioactive water which necessarily accompanies the removal of a separate mandrel and insertion of a separate eddy probe.

Specific Description of the Apparatus of the Invention

Figure 7A:
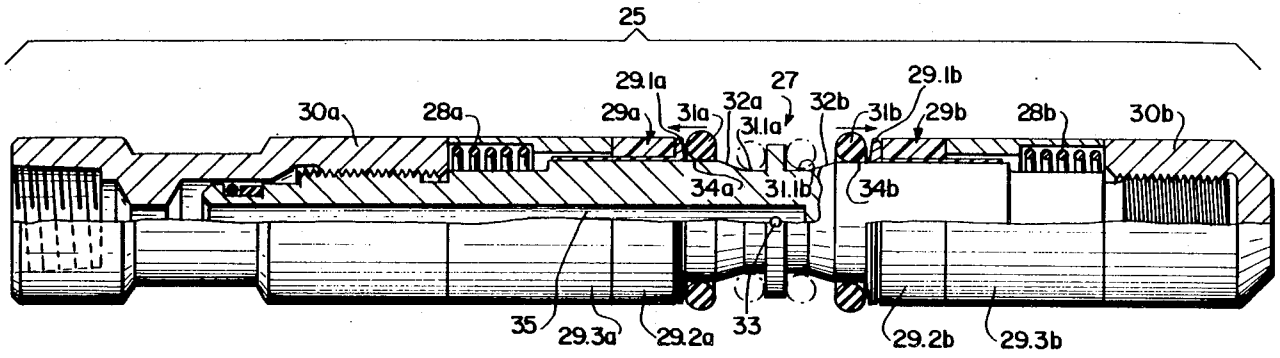
FIGS. 7A and 7B are a partial cross-sectional view of the fluid mandrel of the invention.
Figure 7B:
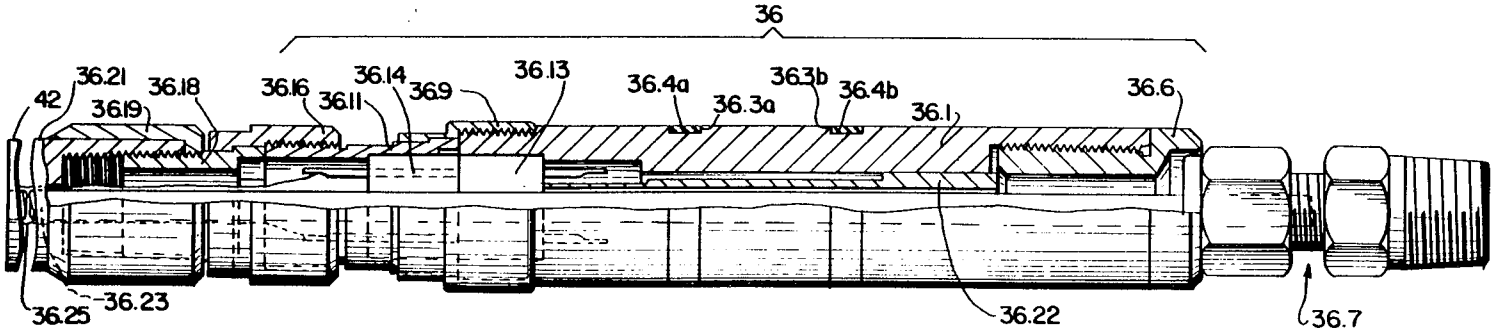
Figure 8:
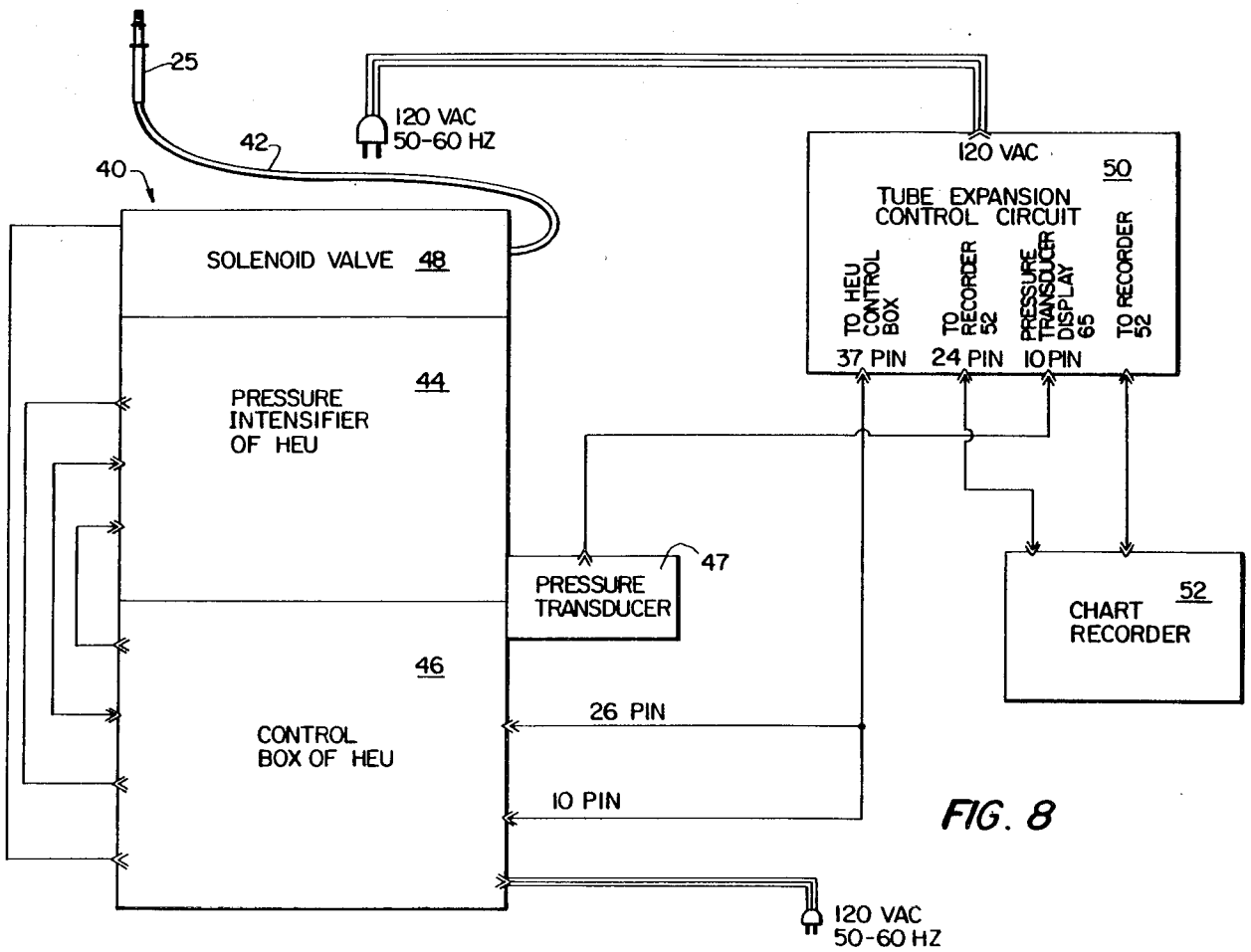
FIG. 8 is a schematic diagram of the apparatus of the invention, illustrating the interrelationship between the hydraulic expansion unit, the control circuit and recorder in block form.

With reference now to FIGS. 7A, 7B and 8, the overall apparatus of the invention generally comprises a hydraulic expansion unit (HEU) 40 which is fluidly connected to a mandrel 25 via high pressure tubing 42, a pressure transducer 47 fluidly connected to the hydraulic expansion unit, a tube expansion control circuit 50 electrically connected to both the pressure transducer 47 and the HEU 40 for controlling the pressure of the fluid discharged from the mandrel 25, and a chart recorder 52 for providing a graph of the pressure of the fluid discharged from mandrel 25 as a function of time.

With specific reference to FIG. 8, the hydraulic expansion unit 40 is preferably a Hydroswage® brand hydraulic expander manufactured by Haskel, Inc., of Burbank, Calif. This particular commercially-available hydraulic expansion unit includes a low pressure supply system and pressure intensifier or fluid amplifier 44, a control box 46 for controlling the operation of the pressure intensifier 44, and a solenoid valve 48 which controls the flow of hydraulic fluid from the pressure intensifier 44 to the fluid mandrel 25 via high pressure tubing 42. The high pressure tubing 42, the pressure intensifier 44, the control box 46, and the solenoid operated valve 48 form a commercially available hydraulic expansion unit, and form no part per se of the claimed invention.

The pressure intensifier 44 of the hydraulic expansion unit 40 is controlled by the tube expansion control circuit 50 operating in conjunction with pressure transducer 47. The pressure transducer 47 converts the pressure of the expansion fluid into an electric signal which can be converted into a pressure/time function by the tube expansion control circuit. In the preferred embodiment, pressure transducer 47 is part of a Model AEC-20000-01-B10 pressure transducer and indicator system manufactured by Autoclave Engineers, Inc. of Erie, Pa. The pressure transducer 47 is fluidly connected to the outlet of the pressure intensifier 44, and electrically connected to the tube expansion control circuit via a 10-pin connector which plugs directly into the pressure transducer display 65 of the circuit 50. The control box 46 of the hydraulic expansion unit is connected to the control circuit 50 via a 37-pin socket as indicated. Finally, the chart recorder 52 (which is preferably a model No. 1241 recorder, manufactured by Soltec Corporation of Sun Valley, Calif.) is connected to the control circuit 50 via a 24-pin connector and a coaxial cable as shown. The chart recorder 52 provides a graphic representation of the pressure of the hydraulic fluid as a function of time during the swaging operation, which is particularly useful in quickly diagnosing malfunction conditions such as leaks or over-pressure conditions which could over-expand the tube 9 being expanded.

With reference back to FIGS. 7A and 7B, the mandrel 25 of the preferred embodiment is an improved mandrel having an eddy current probe assembly 36 detachable mounted beneath it. The mandrel 25 is fluidly connected to pressure intensifier 44 via inner stainless steel tubing 36.23 which extends through the center of the probe assembly 36 as indicated.

With specific reference now to FIG. 7A, the mandrel 25 generally includes a mandrel head 27 having an orifice 33 which is fluidly connected to inner tubing 36.23 via a centrally disposed fluid canal 35 located in the bottom half of the mandrel 25. A pair of opposing, resilient O-rings 31*a*, 31*b* circumscribe the mandrel head 27 on either side of the fluid orifice 33. The O-rings 31*a*, 31*b* are rollingly movable in opposite directions along the longitudinal axis of the mandrel 25 by pressurized fluid discharged from fluid orifice 33. Specifically, the O-rings 31*a*, 31*b* may be rolled out of the annular recesses 31.1*a*, 31.1*b* adjacent the fluid orifice 33, up annular ramps 32*a*, 32*b*, and into a seating engagement between annular shoulders 34*a*, 34*b* and the walls of a tube 9 or sleeve 10, as is best seen in FIG. 3.

It should be noted that the outer edges of the O-rings 31*a*, 31*b* just barely engage the walls of the tube 9 or sleeve 10 when they are seated around their respective annular recesses 31.1*a*, 31.1*b*. While the natural resilience of the O-rings 31*a*, 31*b* biases them into a minimally engaging position in their respective annular recesses 31.1*a*, 31.1*b* when no fluid is discharged out of orifice 33, mandrel 25 further includes a pair of retaining rings 28*a*, 28*b* which are each biased toward the fluid orifice 33 by springs 28*a*, 28*b*, respectively. Springs 28*a*, 28*b* are powerful enough so that any frictional engagement between the interior walls of a tube 9 or sleeve 10 and the outer edges of the O-rings 31*a*, 31*b* which occurs during the positioning of the mandrel 25 therein will not cause either of the rings to roll up the ramps 32*a*, 32*b* and bind the mandrel against the walls of the tube 9 or sleeve 10. Such binding would, of course, obstruct the insertion or removal of the mandrel 25 from a tube 9 or sleeve 10, in addition to causing undue wear on the O-rings themselves. As a final safeguard against such binding of either of the O-rings 31*a*, 31*b*, glycerine is applied to the inside walls of the tube 9 or sleeve 10 and over the outside surfaces of these rings prior to each insertion.

Each of the spring-biased rings 29*a*, 29*b* is actually formed from a urethane ring 29.2*a*, 29.2*b* frictionally engaged to a stainless steel equalizer ring 29.1*a*, 29.1*b* on the side facing the O-rings 31*a*, 31*b*, and a stainless steel spring retaining ring 29.3*a*, 29.3*b* on the side opposite the O-rings 31*a*, 31*b*, respectivley. Urethane rings 29.2*a*, 29.2*b* are resilient under pressure, and actually deform along the longitudinal axis of the mandrel 25 during a tube or sleeve expansion operation. Such deformation complements the function of the O-rings 31*a*, 31*b* in providing a fluid seal between the mandrel head 27 and the inside of a tube 9 or sleeve 10. The equalizer rings 29.1*a*, 29.1*b* insure that the deformation of the urethane rings 29.2*a*, 29.2*b* occurs uniformly around these rings.

In order to arrest the motion of the spring-biased retaining rings 28*a*, 28*b*, stop members 30*a*, 30*b* are provided on either side of the mandrel 25. The top portion of stop member 30*b*, which forms the top of the mandrel body 25, is beveled in order to facilitate the insertion of the fluid mandrel 25 into a tube 9 or sleeve 10. Finally, it should generally be noted that all portions of the mandrel 25 exposed to a significant amount of mechanical stress (such as stop members 30*a*, 30*b* and spring retaining rings 29.3*a*, 29.3*b* equalizers 29.1*a*, 29.1*b* and mandrel head 27)) are formed from HT 17-4 PH stainless steel to insure durability.

The eddy current probe assembly 36 of the invention generally includes a cylindrical probe body 36.1 made of machined Delrin®. Probe body 36.1 contains a stepped, cylindrical sleeve 36.22 also formed from Delrin®. Inside the topmost section of probe body 36.1 is a threaded, cylindrical recess for coupling a threaded male connector 36.7 to the upper end of the probe assembly 36. Stepped sleeve 36.22 further includes a centrally disposed bore for receiving a section of stainless steel tubing 36.23 which is fluidly connected to the hydraulic expansion unit 40 on one end and fluidly connected to the lower end of male fitting 36.7 at its other end. The bottommost end of stepped sleeve 36.22 abuts an electric plug 36.13 which is connected to a pair of sensing coils 36.4*a*, 36.4*b* which will be described in greater detail hereinafter. Electric plug 36.13 is normally engaged in tandem to electric socket 36.14. Finally, the lowermost portion of the probe assembly 36 includes a socket receptacle 36.11 which houses the electrical socket 36.14 as shown. A receptacle ring 36.9 couples the socket receptacle 36.11 to the probe body 36.1. More specifically, the socket receptacle includes an annular shoulder which fits into a complementary annular recess in the receptacle ring 36.9 whereby the socket receptacle 36.11 is drawn into engagement with the probe body 36.1 when the female threads of the receptacle ring 36.9 are engaged into complementary male threads in the lower end of the probe body 36.1 as illustrated. It should be noted that the lower portion of the socket receptacle 36.11 includes male threads which may be engaged onto a set of complementary female threads of an adapter ring 36.16, which couples a tubing adapter 36.18 onto the end of the socket receptacle 36.11. Again, the coupling mechanism in this instance includes an annular shoulder on the topmost end of the tubing adapter which fits inside a complementary annular recess near the bottom of the adapter ring 36.16. The bottom portion of the tubing adapter 36.18 includes male threads which are screwed into a complementary set of female threads in the nylon exterior tubing 42.

The probe body 36.1 of the invention includes fluid-tight, screw-type fittings at either end which render it detachably connectable between the mandrel 25 and the pressurized hydraulic fluid generated by the hydraulic expansion unit 40. Specifically, the upper end of the probe body 36.1 includes the previously described, threaded male connector 36.7 which allows the probe assembly 36 to be screwed into the female connector which normally forms the lower end of the mandrel 25. Similarly, the lower end of the probe body 36.1 includes the previously mentioned socket receptacle 36.11 which includes a set of male threads engageable to an adapter ring 36.16 which couples a tubing adapter 36.18 snugly against the end of the socket receptacle 36.11. The detachable connection between the mandrel 25 and the eddy current probe assembly 36 afforded by male connector 36.7 and the female threads on the receptacle ring 36.9 allows the probe body 36.1 to be easily removed from the mandrel 25 incident to a repair, maintenance or replacement operation.

The eddy current probe body 36.1 includes a pair of spaced, annular recesses 36.3*a*, 36.3*b* onto which a pair of sensing coils 36.4*a*, 36.4*b* are wound. In the preferred embodiment, each coil includes about 200 windings and has a resistance of about 12 ohms. Additionally, the impedance and inductance is preferably the same between the two cells within an error of ±1% or less. The exterior of the radial edge of each of the sensing coils 36.4*a*, 36.4*b* is just below the outside surface of the probe body 36.1. The small gap between the coils and the probe body is preferably filled in by an epoxy resin in order to protect the delicate windings of the coils, and to render the surface of the probe body flush at all points. In the preferred embodiment, the outside edges of the coils 36.4*a*, 36.4*b* along the longitudinal axis of the probe body 36.1 are spaced the same distance as the width of the stucture whose position they will detect. In the case of baffle plates in most nuclear steam generators, this distance corresponds to ¾ths of an inch, since the baffle plates in these generators are about ¾ths of an inch thick. When these sensing coils 36.4*a*, 36.4*b* are connected to conventional eddy current probe circuitry, such coil spacing yields a lissajous curve with a point intersection whenever the longitudinal edges of these coils are flush with the top and bottom edges of a ¾-inch metallic baffle plate. Additionally, such spacing of these coils 36.4*a*, 36.4*b* in no way interferes with the use of these coils in detecting defects or deposits along the walls of the tubes 9, or in mapping a profile of interference joints generated by the mandrel body 25 between a sleeve 10 and a tube 9. Hence, probe assembly 36 may also be used in sleeving operations, and is particularly suited for sleeving operations where the sleeve must be fitted across a section of a tube 9 surrounded by a metallic structure, such as a baffle plate 13.

As previously mentioned, probe body 36.1 includes a socket receptacle 36.11 for housing an electrical socket 36.14. The socket 36.14 is detachably connectable with an electric plug 36.13 which is in turn connected to the four lead wires of the sensing coils 36.4*a*, 36.4*b*. The provision of an electric plug 36.13 and socket 36.14 in the probe body 36.1 complements the function of the male connector 36.7 and the female threads of the receptacle ring 36.9 in allowing the entire probe body 36.1 to be conveniently detached from the mandrel 25 and tubing 42. The four lead wires of the sensing coils 36.4*a*, 36.4*b* are connected to conventional eddy current circuitry via coaxial cable 36.25. In the preferred embodiment, the eddy current circuitry used is a MIZ 12 frequency multiplexer manufactered by Zetec of Isaquah, Wash. The leads of the coils 36.4*a*, 36.4*b* are connected to the MIZ 12 Zetec frequency modules which are set up so that coil 36.4*a* functions as the "absolute" coil.

It should be noted that the positioning of the eddy current assembly 36 below the mandrel 25, as opposed to above the mandrel 25, advantageously avoids the necessity of passing connecting wires from the sensing coils 36.4*a*, 36.4*b* through the high pressure region generated around the mandrel head 27.

Figure 9:
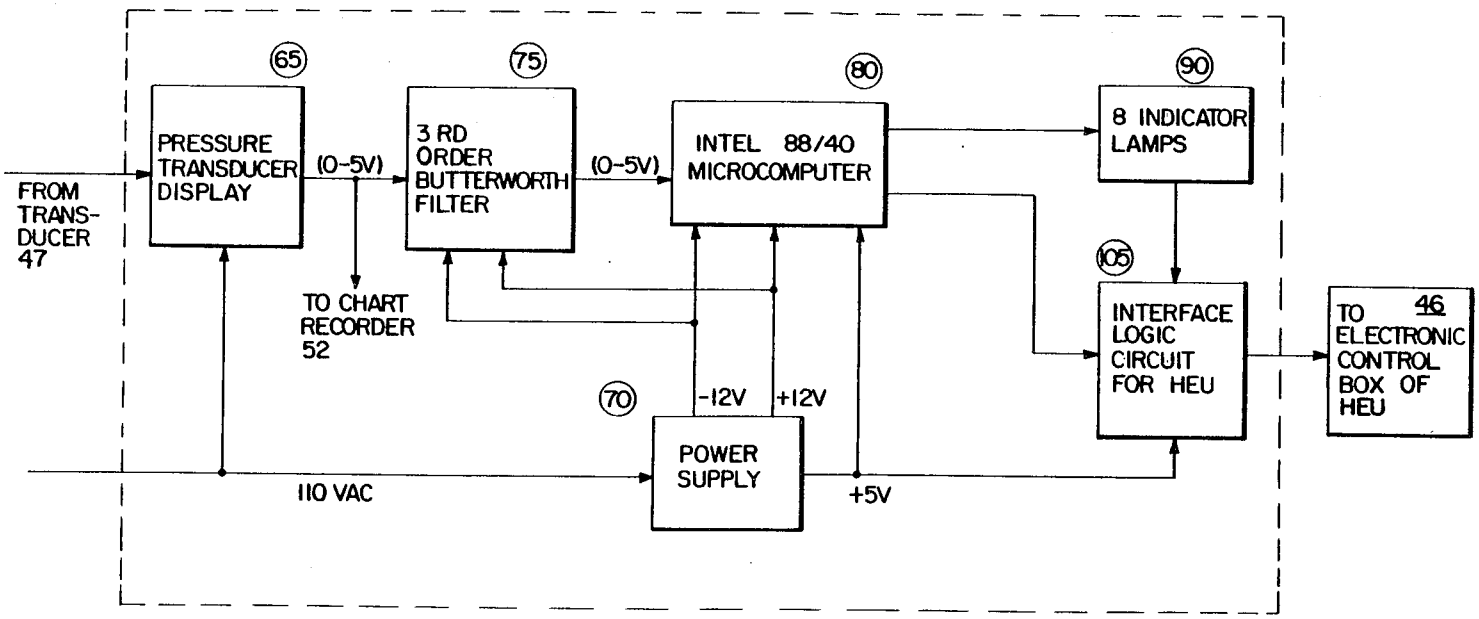
FIG. 9 is a block diagram of the control circuit of the hydraulic expansion unit of the invention, which includes a computer circuit.

Turning now to FIG. 9, the tube expansion control circuit 50 of the invention generally comprises a pressure transducer display 65, which relays the electric signal it receives from the pressure transducer 47 to an Intel 88/40 microcomputer 80 through a third-order Butterworth filter 75. The input of the chart recorder 52 is tapped off the connection between the pressure transducer display 65 and the third-order Butterworth filter 75 as indicated. The output of the microcomputer 80 is connected in parallel to an indicator lamp circuit 90 containing eight indicator lamps, and to an interface logic circuit 105, which in turn is electrically connected to the control box 46 of the hydraulic expansion unit 40. The third-order Butterworth filter 75, the microcomputer 80, the indicator lamp circuit 90, and the interface logic circuit 105 are all connected to a power supply 70 which converts 110 volts A.C. into 12 volts for the operational amplifiers (or op-amps) of the Butterworth filter 75 and microcomputer 80, and 5 volts for the TTL logic circuits of the microcomputer 80, the interface logic circuit 105 and the indicator lamps in the lamp circuit 90. In the preferred embodiment, the pressure transducer display 65 is part of the model AEC-20000-01-B10 pressure transducer and display assembly circuit manufactured by Autoclave Engineers, Inc., of Erie, Pa.

Generally speaking, the signal from the pressure transducer 47 enters the input of the Intel 88/40 microcomputer through the pressure transducer display 65, and the third-order Butterworth filter 75. Filter 75 smoothes the pressure signal relayed from the transducer 47 by removing the high frequency "ripple" component superimposed thereon. The removal of such ripple from the pressure function is important, since the invention relies heavily upon the detection of inflection points in the pressure function in making its control decisions. The eight indicator lamps of the lamp circuit 90 are preferably mounted onto a control panel (not shown), and provide a visual indication to the operator of various malfunction conditions, as will be explained in more detail hereinafter. The interface logic circuit 105 generally includes a pair of NOR gates which shut off the hydraulic expansion unit 40 by triggering a solid state relay 109 whenever a leak or other malfunction condition is detected by the microcomputer 80. The Intel 88/40 microcomputer 80 is programmed to monitor the pressure function every one-tenth of a second, and to continue or to cut off the hydraulic pressure to the interior of the tube 9 being expanded, depending upon the inflections in electric signals it receives from the pressure transducer 47.

Figure 10A:
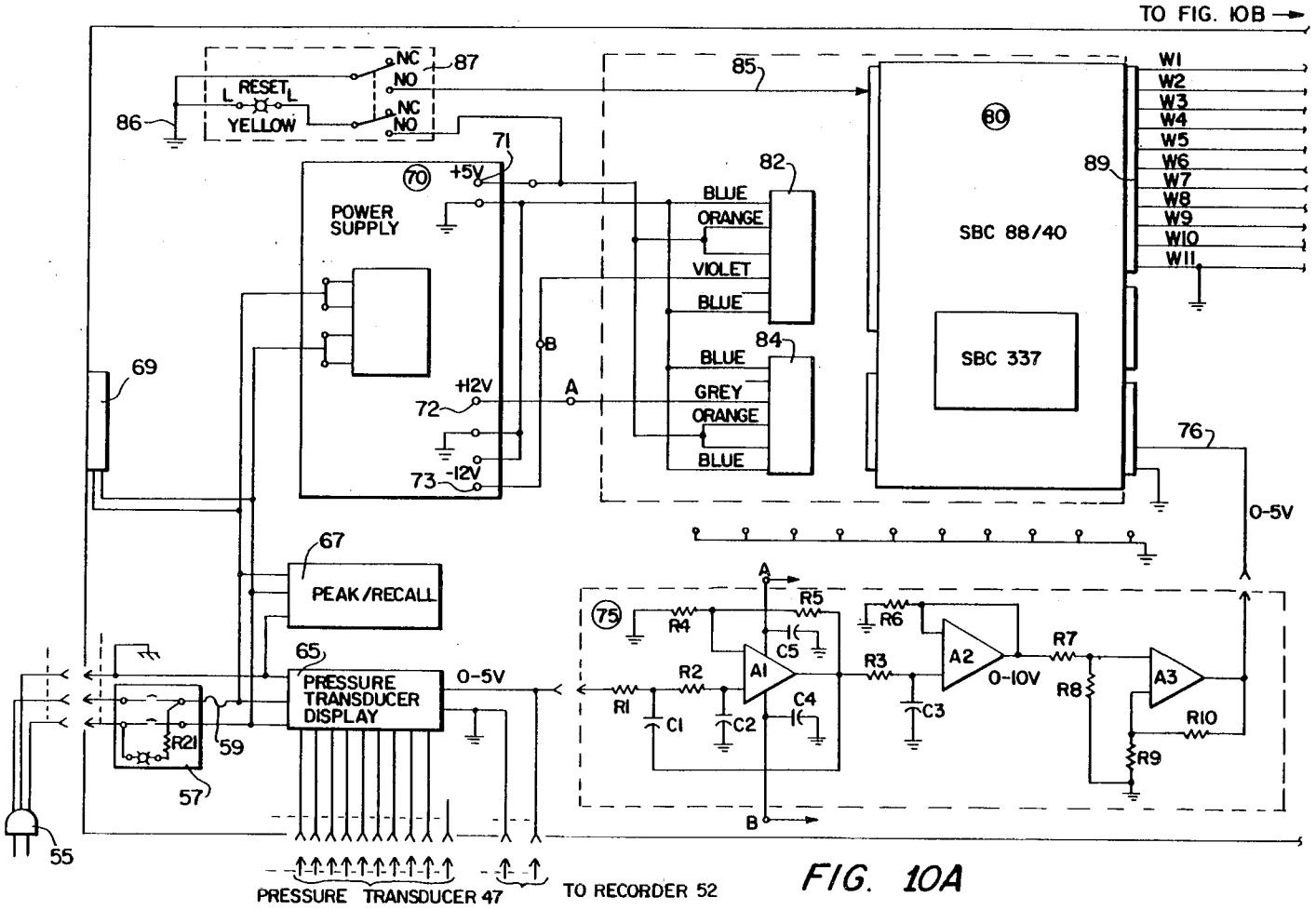
FIGS. 10A and 10B are a schematic diagram of this control circuit.
Figure 10B:
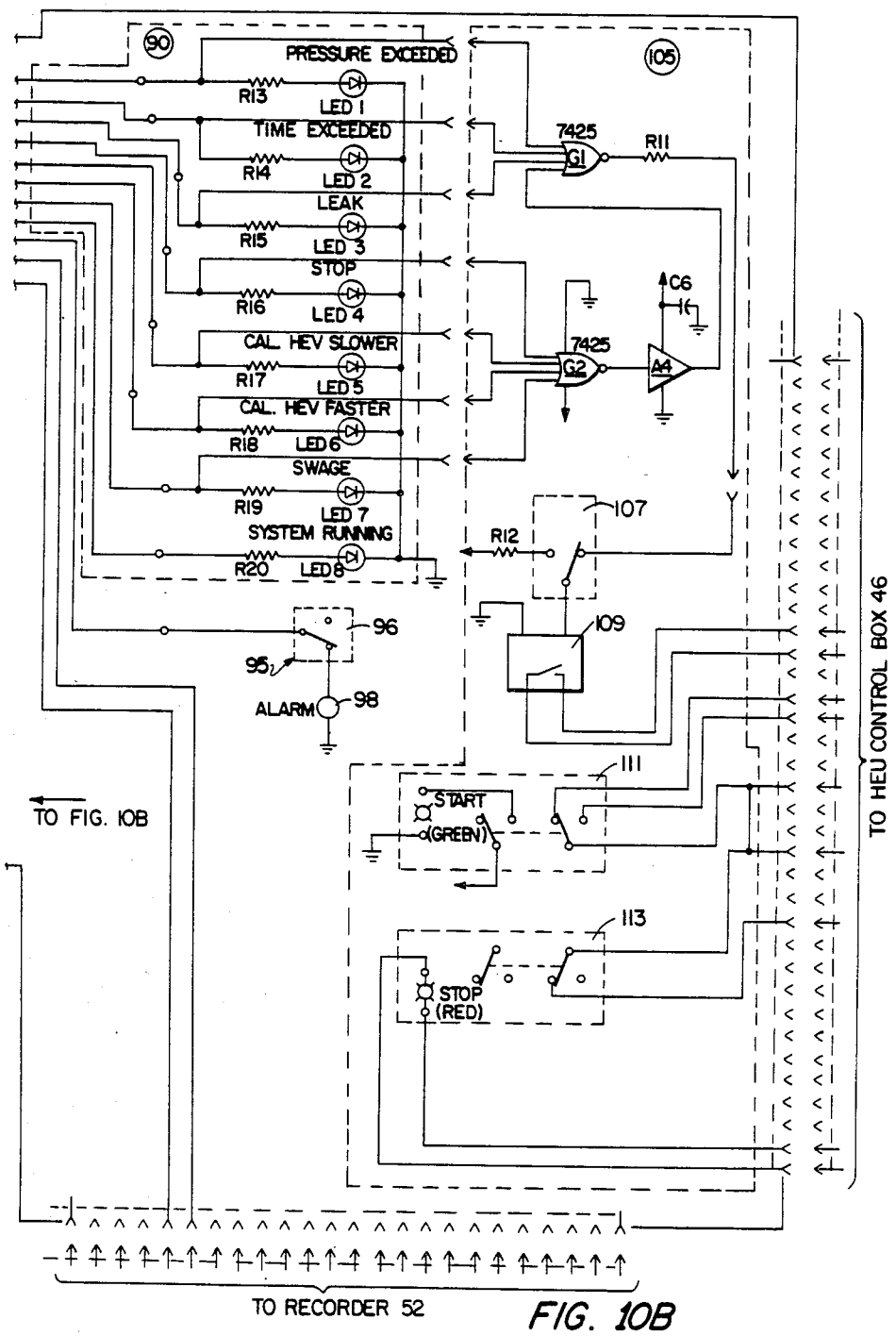

Detail of the control circuit 50 are illustrated in the schematic diagram shown in FIGS. 10A and 10B. Power enters the HEU control circuit 50 from a conventional wall socket by way of three-pronged plug 55. The 120 volts A.C., 60-cycle current is connected in parallel to a pressure transducer display 65, a peak/recall circuit 67, and power supply 70 through a circuit breaker 57 and a fuse 59. The pressure transducer display 65 is connected to the pressure transducer 47 by way of a 10-pronged plug as indicated. The pressure transducer display converts the signal it receives from the pressure transducer 47 into a real time, continuous visual display of the pressure of the hydraulic fluid inside the tube 9 during the expansion process. The pressure transducer display 65 is connected in parallel with peak/recall circuit 67. The peak/recall circuit 67 includes a memory circuit which stores the value of the highest pressure reading transmitted to the pressure transducer 47 from the pressure transducer display 65. Like transducer 47 and display 65, the peak/recall circuit is a component of the model AEC-20000-01-B10 pressure transducer and display assembly manufactured by Autoclave Engineers, Inc. of Erie, Pa. A cooling fan 69 is connected between the peak/recall circuit 67 and the power supply 70. Fan 69 circulates a cooling stream of air through the control circuit 50, and may be any one of a number of conventional structures. Power supply 70 is likewise preferably a conventional, commercially available component, such as a model No. UPS-90-5-12-12 power supply, manufactured by Elpac Power Systems of Santa Ana, Calif. Such a power supply includes a +5 volt terminal 71 which, in the preferred embodiment, is connected to orange color-coded wires which are electrically engaged to terminals 82 and 84 of the microcomputer 80. The orange color-coded wires are in turn connected to the TTL logic circuits of the microcomputer 80, and the NOR gates 61 and 62 of the interface logic circuit 105. The power supply 70 further includes a +12 volt terminal which is connected to a gray color-coded wire engaged to terminal 84, and a −12 volt terminal connected to a violet color-coded wire engaged to terminal 82 of the microcomputer 80. As indicated at "A" and "B" on the gray and violet color-coded wires, the +12 and −12 volt terminals of the power supply are connected not only to the microcomputer 80, but also across operational amplifier A1 in the third-order Butterworth filter 75. A reset circuit 87 is connected between the +5 volt terminal 71, output wire 85 of the microcomputer 80, and ground terminal 86. Reset circuit 87 includes a double switch capable of actuating a reset indicator lamp 88 while "grounding out" the reset pin of the microcomputer 80, which resets its software back into a "start" position in a manner well known in the computer art.

Turning now to the informational input circuit of the microcomputer 80, the electrical signal generated by the pressure transducer 47 is relayed to the microcomputer 80 through the pressure display 65, and the filter 75. The electrical signal from the pressure transducer generally ranges between 0 and 5 volts, depending upon the pressure of the fluid inside the tube 9 being expanded. However, since the raw signal originating from the pressure transducer 47 includes a component of high frequency ripple, and since the microcomputer makes its decisions on the basis of perceived inflections in the slope of the function of pressure over time, some means for eliminating this ripple must be included in the control circuit 50; otherwise, the microcomputer 80 could make erroneous decisions on the basis of false inflections caused by the high frequency ripple. The third-order Butterworth filter eliminates this high pressure function so that the microcomputer makes its decisions on the basis of actual inflection points which occur in the curve of the pressure function plotted over time. While a second-order Butterworth filter would probably work, a dynamic, low-pass filter containing three R.C. circuits to ground-out the ripple component of the signal generated by pressure transducer 47 is preferred to insure reliable operation of the apparatus.

In the preferred embodiment, the resistances in the third-order Butterworth filter circuit 75 are of the following values (plus or minus one percent):

R1=31 kilo-ohms
R2=31 kilo-ohms
R3=31 kilo-ohms
R4=10 kilo-ohms
R5=10 kilo-ohms
R6=10 kilo-ohms
R7=20 kilo-ohms
R8=10 kilo-ohms
R9=20 kilo-ohms
R10=10 kilo-ohms The capacitors in the filter circuit 75 preferably have the following values:

C1=1 microfarad
C2=1 microfarad
C3=1 microfarad
C4=0.1 microfarad
C5=0.1 microfarad Finally, each of the operational amplifiers A1, A2 and A3 in the filter circuit 75 is preferably a TL-074 op-amp manufactured by Texas Instruments, Inc. of Dallas, Tex. It should be noted that amplifier A3 is included in the filter circuit 75 in order to compensate for the gain in the signal caused by amplifier A2. Specifically, amplifier A3 takes the 0 to 10 volt signal generated by amplifier A2 and converts it back into a 0 to 5 volt signal, which is the same voltage range which characterizes the raw signal from transducer 47. The R.C. circuits of the filter circuit 75 filter out all signals having a frequency of 5 Hz or higher, and transmit this filtered signal into the input side of the microcomputer 80 via connecting wire 76.

Microcomputer 80 is preferably an Intel 88/40 microcomputer manufactured by the Intel Corporation of Santa Clara, Calif., which includes an analog/digital converter, a SBC-337 math module, and a 0.1 second timer. The math module and the timer give the microcomputer 80 the capacity to compute the second derivative of the pressure-over-time function every tenth of a second, which is necessary if the microcomputer 80 is to make proper decisions based on inflections in the pressure function. Although the aforementioned Intel 88/40 microcomputer is preferred, any microcomputer may be used which has an analog-to-digital converter, a 0.1 second timer, the capacity to compute second derivatives, and the ability to execute the program depicted in flow chart form in FIGS. 11A, 11B, 12A, 12B and 12C. As is indicated in FIGS. 10A and 10B, microcomputer 80 also includes an output terminal 89 having 11 output wires designated W1 through W11. Output wires W1 through W8 are each connected to one of eight panel lamps of the control circuit 50. Output wire W9 is connected to alarm circuit 95, while the remaining two wires, W10 and W11, are connected to the recorder 52.

Turning now to the lamp circuit 90 of control circuit 50, circuit 90 includes eight light-emitting diodes designated LED 1 through LED 8 in FIG 10B. In the preferred embodiment, each of the LEDs 1 through 8 is preferably a Model T-1 ¾ LED which may be purchased from the Dialight Corporation of Brooklyn, N.Y. Resistors R13 through R20 are serially connected in front of the LEDs 1 through 8 in order to protect them from receiving a potentially damaging amount of current from the electrical signal generated by the microcomputer 80. In the preferred embodiment, resistors R13 through R20 have a resistance of 100 ohms ±5%. LEDs 1 through 8 are mounted on a control panel (not shown). LED 1 lights whenever a "pressure exceeded" condition is detected by the microcomputer 80. LEDs 2 and 3 are actuated whenever a "time exceeded" condition or a "leak" condition is detected by the microcomputer 80, respectively. LED 4 lights whenever the operator commands the hydraulic expansion unit to stop its operation. LEDs 5 and 6 light whenever the microcomputer 80 decides that the hydraulic expansion unit ought to be calibrated to run at either a slower or a faster rate, respectively. LED 6 lights whenever the microcomputer 80 decides that the tube 9 has been successfully expanded or swaged, and LED 8 lights whenever the hydraulic expansion unit is running normally.

The basic function of logic interface circuit 105 is to shut down the hydraulic expansion unit 40 in the event that a malfunction condition is detected by microcomputer 80 by opening the switch in solid-state relay 109. Circuit 105 includes a pair of NOR gates G1 and G2 connected in parallel with output wires W1 through W7 of microcomputer 80. Each of the NOR gates is preferably a 7425 TTL circuit manufactured by Texas Instruments, Inc., of Dallas, Tex. The output of NOR gate G1 is connected to solid-state relay 109 via relay resistor R11, which has a value of 1 kilo-ohm±5% in the preferred embodiment. Solid-state relay 109 is a conventional 3–32 volts D.C. relay which is connected in series with the power line (not shown) leading to the hydraulic expansion unit 40. In the preferred embodiment, solid-state relay 109 is a model No. W612505X-1 relay manufacture by Magnecraft Corporation of Chicago, Ill. The top three input wires of NOR gate G1 are connected to output wires W1, W2 and W3, respectively. When the computer detects either a "pressure exceeded", "time exceeded", or a "leak" condition, it lights the appropriate LED and opens the normally closed solid-state relay 109 so as to disconnect the power to the hydraulic expansion unit 40. Similarly, the four input wires of NOR gate G2 are connected to W4, W5, W6 and W7, respectively. The output of NOR gate G2 is connected to the bottom-most input wire of NOR gate G1 via inverter circuit A4. Inverter circuit A4 includes a capacitor C6 which, in the preferred embodiment, has a capacitance of 0.1 microfarad. When the microcomputer 80 detects either a "stop" or "swage" condition, or decides that the hydraulic expansion unit ought to be calibrated either slower or faster, it opens the solid-state relay 109 via inverter A4 and NOR gate G1. This deactuates the hydraulic expansion unit 40 by disconnecting the power line thereto. In short, the interface logic circuit 105 deactuates the hydraulic expansion unit 40 whenever any of the LEDs (other than the "system running" LED 8) is actuated. It should be noted that control circuit 50 also includes a switching circuit 107 which allows the operator of the apparatus of the invention to manually override any HEU-deactuating signal transmitted by the interface logic circuit 105.

Alarm circuit 95 includes a manual switch 96 connected to one of the output wires of the microcomputer 80, and a electric alarm 98 which may be any one of a number of conventional audio or visual alarm mechanisms. Microcomputer 80 will trigger the alarm 98 for five seconds upon the occurrence of any of the malfunction conditions associated with the interface logic circuit 105 and lamp circuit 90. In the preferred embodiment, alarm 98 preferably is a "Sonalert" brand audio alarm manufactured by the Mallory Corporation of Indianapolis, Ind. Switch 96 allows the alarm 98 to operate when switch 107 is switched to the "computer mode.

Finally, the control circuit 50 of the invention includes a "start" switch 111, and a "stop" switch 113. The "start" switch 111 preferably includes lamps serially connected to the flow of current for indicating when the hydraulic expansion unit has been started. The "stop" switch 113 lights only when the HEU piston goes full stroke. In the preferred embodiment, switches 111 and 113 are Model No. 554-1121-211 switches manufactured by the Dialight Corporation of Brooklyn, N.Y.

Process of the Invention

The process of the invention may be applied both to tube/baffle plate expansions and to sleeve/tube expansions. In both instances, the control circuit 50 of the apparatus of the invention monitors the fluctuations of a variable associated with the elastic and plastic characteristics of the particular tubes involved, and computes a final swaging pressure on the basis of an empirically derived formula.

A.

As Applied to Tube/Baffle Plate Expansions

As previously explained, the first step in applying the process of the invention to a tube/baffle plate expansion is to clean the interior surface of the tube 9 with a rotary brush (not shown), if necessary. Next, the interior walls of the tube 9 are swabbed with a lubricant such as glycerin in order to prevent the O-rings 31*a*, 31*b* from binding against the walls of the tube 9 by rolling up ramps 32*a*, 32*b* during the insertion process. Additionally, some glycerin may be applied to the outer surfaces of the O-rings themselves to provide further insurance against such binding.

Next, as may best be seen with reference to FIGS. 2, 3, 7A and 7B, the mandrel 25 is inserted through the tube 9 and around the vicinity of the baffle plate 13 with the eddy current probe assembly 36 actuated. The eddy current probe assembly 36 will generate a lissajous curve with a point intersection when the edges of the coils 36.4*a*, 36.4*b* along the longitudinal axis of the probe assembly 36 are flush with the upper and lower edges of the baffle plate 13. Once the coils 36.4*a*, 36.4*b* are so positioned, the operator pulls the mandrel 25 down the tube a known number of inches (distance "X") in order to position properly the center line of the mandrel head 27 with the center line of the baffle plate 13.

The operator then turns on both the hydraulic expansion unit 40 and the control circuit 50. At this juncture, the microcomputer 80 of the control circuit 50 begins to execute the program illustrate in the flow chart of FIGS. 11A and 11B.

In the first step 120 of this program, reset circuit 87 is actuated, which grounds out the reset terminal of the microcomputer 80, bringing it to the "start" position in the program. Such grounding out initializes all of the pressure-related variables in the memory of the microcomputer 80, and actuates the "system running" LED in the lamp circuit 90 of the control circuit 50. At this point in time, none of the LEDs 1 through 7 are lighted; therefore, the solid-state relay 109 is in a closed condition which in turn allows the continued transmission of power to the hydraulic expansion unit 40.

The microcomputer 80 next proceeds to step 123 of the program, and begins to sample the pressure reading transmitted to it from pressure transducer 47 via filter circuit 75 every one-tenth of a second. With every sampling, the microcomputer 80 asks the question designated in question block 124 as to whether or not the pressure reading received from the transducers 47 is above 12,000 psi. Such a high reading is indicative of a variety of malfunction conditions, such as improper positioning of the mandrel 25 above or below the baffle plate 13. If the microcomputer 80 receives a positive response to this inquiry, it proceeds to step 125 of the program and lights the "pressure exceeded" LED, and disconnects the power from the hydraulic expansion unit by opening the switch in solid-state relay 109. However, if it receives a negative response to this inquiry, it begins to calculate the first derivatives of the pressure time function as indicated in block 126. The computation of these first derivatives is necessary for the microcomputer 80 to calculate the second derivatives, which indicate the inflection points in the curve defined by the function of pressure over time.

After the microcomputer 80 begins to calculate the first derivatives of the pressure function, it proceeds to block 128 of the program and begins building the curve of the function of pressure over time by updating the pressure readings it receives from the pressure transducer 47 every one-tenth of a second, and storing these values along with their first derivatives in its memory. Simultaneously, the microcomputer 80 begins to average the first derivatives of the updated pressures, as indicated in block 130 of the program.

After the microcomputer 80 begins to average the first derivatives of the pressure over time function, it begins to calculate the second derivatives of the pressure over time from the averaged first derivatives, as indicated in program block 132. The compution of the second derivatives from the averaged first derivatives, instead of individual first derivative points, reinforces the function of the filter circuit 75 in preventing the microcomputer from erroneously determining that it has detected the first inflection point or "knee" in the function of pressure over time. As previously discussed, this first knee occurs when the expansion of the Inconel tube has crossed over from the elastic zone of the graph of FIG. 4 into the plastic zone.

After the microcomputer 80 begins to calculate the second derivative of the pressure function, it proceeds to question block 134 and inquires whether or not the pressure of the hydraulic fluid within the tube 9 is over 3,500 psi. If it receives a negative response to this inquiry, it simply loops back to block 123 and continues to sample the growing pressure of the hydraulic fluid while continuously computing the first and second derivatives of the pressure over time function. When the answer to this inquiry is "yes", it proceeds to block 136 of the program and starts chart recorder 52. The reason that the microcomputer 80 is programmed to start the chart recorder 52 only after a pressure of 3,500 psi has been achieved within the tube 9 is to eliminate the recordation of useless information on the chart recorder 52. The yield points of the Inconel tubes in either the Model D4, D5 or E steam generator is well about 3,500 psi; therefore, the recordation of the pressure function in the range between 0 and 3,500 psi would serve no useful purpose.

After chart recorder 52 has been actuated, the microcomputer 80 proceeds to question block 138, and inquires whether or not leaks are present. The microcomputer 80 decides whether or not such a leak condition is present by sensing the sign of the first derivative of the function of pressure over time. Simply stated, if the slope of this curve is anything but positive for a time period exceeding one second, or if the microcomputer 80 detects a 300 psi drop in the pressure, it will proceed to block 139 and actuate the "leak" LED in the lamp circuit 90, which in turn will open the switch in the solid-state relay 109 and deactuate the hydraulic expansion unit. However, if the slope of the pressure function remains positive, and if there are no pressure drops of 300 psi or more, the microcomputer 80 will proceed to block 142.

At question block 142, the microcomputer 80 inquires whether or not the hydraulic expansion unit is running too fast. It makes this decision on the basis of the value of the slope of the pressure function just before the first knee in the curve. If the slope exceeds a value of 2,500 psi/sec$^2$, the microcomputer 80 proceeds to block 143 and lights the "calibrate HEU slower" LED of the lamp circuit 90, and trips the solid-state relay 109 which in turn deactuates the expansion unit. The ability of the control circuit 50 to sense whether the hydraulic expansion unit is running too fast and building up hydraulic pressure inside the Inconel tube 9 at too rapid a rate is important. Under such conditions, the tube 9 expands so quickly that work hardening takes place which causes the yield point of the tube to move up. The heightened yield point, in combination with the brittleness caused by the work hardening of the tube 9, adversely affects the accuracy of the process and could cause the tube to expand poorly before full contact is made between the tube 9 and the bore 14 of the baffle plate 13.

Assuming that the microcomputer 80 determines that the HEU is not running too fast, it next proceeds to question block 144 and asks whether or not the hydraulic expansion unit is running too slow. Such a slow-running HEU adversely draws out the time required for completing the expansion process, which is highly undesirable in view of the fact that many hundreds of expansions are frequently necessary to correct the tube clearance problems present in nuclear steam generators. Additionally, such a slow rate of expansion tends to straighten the inflection point regions of the pressure/-time curve so much that the microcomputer 80 has difficulty deciding whether or not an actual inflection has in fact occurred. In answering the question in block 144, the microcomputer 80 again looks at the value of the slope of the pressure function as determined by the first derivative of this function. If the value of this slope or first derivative is under 750 psi/sec$^2$, the microcomputer 80 proceeds to block 145 and actuates the "calibrate HEU faster" LED and trips solid-state relay 107, thereby deactuating the hydraulic expansion unit. If, on the other hand, the answer to the inquiry of block 144 is negative, the microcomputer 80 proceeds to question block 146.

At block 145.5 of the program, the microcomputer 80 senses the first "knee" or inflection point in the function of pressure over time by confirming that the value of the second derivative of the function is a non-zero quantity. As previously stated, this first inflection point indicates when the metal of the Inconel tube 9 has been expanded beyond its elastic point, and into the plastic region illustrated in the right side of the graph of FIG. 4. After confirming that it has sensed the first knee in the curve of the pressure function, the microcomputer 80 then proceeds to question block 146.

At question block 146, the microcomputer 80 inquires whether or not there is a contact between the walls of the Inconel tube 9, and the walls of bore 14 of baffle plate 13. It answers this question by determining whether or not the second derivative of the pressure over time function becomes non-zero for the second time, indicating the second inflection point or knee shown in the graph of FIG. 4. If such contact is not detected after a predetermined amount of time, the microcomputer proceeds from question block 146 to block 147, and actuates the "time exceeded" LED of lamp circuit 90. At the same time, the microcomputer 80 trips solid-state relay 109, thereby cutting off the power to the hydraulic expansion unit. This particular block in the program helps prevent an inadvertent bulging of a tube above or below the plate 13 when the mandrel 25 is improperly located with respect to the bore 14 of the baffle plate 13, in which case there would be no second inflection point in the function of pressure over time.

Assuming that the microcomputer 80 recieves a positive response to its inquiry as to whether or not a contact had been made, it proceeds next to block 148 of the program and confirms the existence of the second inflection point. Once the second knee or inflection point has been confirmed, it proceeds to question block 150 and inquires whether or not the hydraulic pressure inside the tube 9 at the time of contact was greater than or equal to 8,000 psi. If the answer to this inquiry is affirmative, the microcomputer 80 proceeds to block 151 and increases the pressure inside the tube 9 to 10% over the contact pressure. If the answer to the inquiry of question block 150 is negative, the microcomputer 80 proceeds to block 152 and increases the pressure inside the tube only 6% over the contact pressure. As previously described, the reason for increasing the pressure either 10% or 6% over the contact pressure is to compensate for the residual elasticity of the tube 9 in the plastic region of the graph illustrated in FIG. 4 so that the tube 9 assumes the properly expanded shape illustrated in FIG. 3 after the pressure in the hydraulic fluid is relieved. It should be noted the 8,000 psi inquiry of block 150, and the 10% and 6% values in blocks 151 and 152 are all empirical decision parameters arrived at through experimental observation by the inventors, and are not the result of computations based upon any known theory. It should further be noted that these particular values are specifically applicable to the Inconel heat exchange tubes in Model D4, D5 and E steam generators, and that these specific values might be different for conduits having different elastic and plastic properties.

After the microcomputer 80 increases the pressure of the hydraulic fluid inside the tube 9 by either 10% or 6%, it next proceeds to block 154, and lights the "swage" LED. Such an actuation of the "swage" LED also causes NOR gate G2 to trip the solid-state relay 109 to disconnect the hydraulic expansion unit from its power source, thereby completing the process of the invention as applied to tube/baffle plate expansions.

B.

As Applied to Sleeving

When the process of the invention is applied to a sleeving operation, the preliminary rotary brush cleaning and swabbing of the interior walls of the tubes 9 and mandrel O-rings with glycerine is normally dispensed with, as is the step of precisely locating the expansion area of the tube by means of an eddy current probe assembly 36 fixed onto a mandrel 25. Instead, a conventional, double-coiled eddy probe is first inserted into each tube 9 to locate the general area of corrosion, which in most cases is the tube section adjacent the tubesheet 7. Once the eddy current probe has confirmed that the section of the tube 9 adjacent the tubesheet 7 is indeed the section in need of sleeving, the next step of the sleeving operation normally involves sliding a stainless steel sleeve over a sleeving-type mandrel well known in the art, an example of which is disclosed in U.S. Pat. No. 4,368,571. Such sleeving mandrels are rigid, and designed for positioning all of the reinforcing sleeves 10 in approximately the same positions above the tube sheet 7 of the reactor. It should be noted, however, that if an area of a tube 9 required sleeving in the vicinity of a baffle plate 13, the previously discussed mandrel 25 and eddy current probe assembly 36 would be most useful, since the probe assembly 36 could be used to insure that the joints of the interference fittings were properly positioned across the bore 14 and the baffle plate 13 surrounding the tube 9. In such an application, probe assembly 36 could not only properly position the mandrel head 27 on either side of the baffle plate 13, but could also be used to generate an electronic profile of the joints made which would confirm both the proper location and the soundness of the joints.

In either event, once the operator of the apparatus is confident that the sleeve and mandrel combination is properly positioned within the tube 9, he actuates both the hydraulic expansion unit 40, as well as the control circuit 50. Consequently, the microcomputer 80 of the control circuit 50 begins to implement the program illustrated in FIGS. 12A, 12B and 12C.

In the first step 160 of this program, reset circuit 87 is actuated, which grounds out the reset terminal of the microcomputer 80. This in turn brings it to the "start" position in the program. Such grounding out initializes all of the pressure-related variables in the memory of the microcomputer 80, and actuates the "system running" LED in the lamp circuit 90 of the control circuit 50. At this juncture, none of the LEDs 1 through 7 are lighted. Therefore, the solid-state relay 109 is in a closed condition which in turn allows the transmission of power to the hydraulic expansion unit 40.

The microcomputer 80 next proceeds to step 164 of the program, and begins to sample the pressure reading transmitted to it from pressure transducer 47 via filter circuit 75 every 1/10th of a second. With every sampling, the microcomputer 80 calculates the first derivatives, or slopes, of the sample pressure points it senses. The continuous computation of the first derivatives of these points is necessary in order for the microcomputer 80 to sense inflection points in the pressure-over-time curve which it is generating. Since the microcomputer 80 determines the final swaging pressure on the basis of these inflection points, the continuous calculation of these first derivatives is a critical step in the program.

While the microcomputer 80 is sampling the pressure in calculating the first derivatives, it is simultaneously asking the question designated in question block 168; i.e., is the pressure equal to or greater than 3,500 psi? If the answer to this question is negative, it continues to sample pressures and calculate first derivatives, as indicated by the loop in the flow chart. However, when the answer to this inquiry is affirmative, it starts the chart recorder as indicated in block 170. The reason that the microcomputer 80 is programmed to start the chart recorder 52 only after a pressure of 3,500 psi is achieved, is to eliminate the recordation of useless information on the chart recorder 52. The yield points of the sleeves used in the sleeving process are well about 3,500 psi. Accordingly, block 168 prevents the recordation of useless information.

After the chart recorder 52 has been started, the microcomputer 80 proceeds next to question block 172, and inquires whether or not leaks are present. The microcomputer 80 uses the same criteria in question block 172 as was previously described with reference to block 138 of the tube/baffle plate expansion process. If a leak is detected at this juncture, the microcomputer 80 actuates the "leak" indicator of the indicator lamp circuit 90, and turns off the hydraulic expansion unit 40, as indicated by block 173. However, if the answer to this inquiry is negative, the microcomputer 80 proceeds to question blocks 174 and 176, and inquires whether or not the hydraulic expansion unit is running too fast or too slow.

In determining whether the answer to the inquiries of question blocks 174 and 176 are positive or negative, the microcomputer 80 uses the same decision criteria hereinbefore described with respect to decision blocks 142 and 144 of the baffle plate/tube expansion program.

Assuming the hydraulic expansion unit 40 is running at an acceptable rate, the microcomputer 80 then proceeds to question block 178, and inquires whether or not the unit 40 is still running 28 seconds after detecting a pressure of 4,000 psi in the tube. Because a positive answer to this inquiry indicates a slow leak or other malfunction condition, the microcomputer 80 proceeds in this instance to block 179 and actuates the "time exceeded" indicator in the indicator lamp circuit 90, and cuts off the power to the expansion unit 40. However, if the answer to this inquiry is negative, the system is running normally and microcomputer 80 proceeds to question block 180.

At question block 180, the microcomputer 80 inquires whether or not the pressure is equal to or greater than 14,000 psi. In the case of Inconel tubes in Combustion Engineering steam generators, the applicants have empirically determined that 14,000 psi corresponds to a point on the pressure curve (illustrated in FIG. 6) which is just before the third inflection point of the curve. As previously explained, the location of this point is critical to the determination of the final swaging pressure, since this final pressure is dependent upon an empirically determined line function which originates from this point. However, it should be noted that in lieu of choosing a predetermined point on the pressure curve such as this program does, the process of the invention could also work by detecting and confirming the third inflection point, and retrieving from its memory the position of the point just before this third inflection point.

If the microcomputer 80 determines that the pressure is not equal to or greater than 14,000 psi, it loops back to block 164 and continues to sample the pressure of the fluid inside the tube. When this pressure finally builds up to 14,000 psi or greater, the microcomputer 80 next proceeds to block 182, and calculates the slope of the point of the pressure curve corresponding to 14,000 psi and designates it as the "reference slope" in its memory. This is a critical step, since the computation of the slope of the empirically-derived line function is dependent upon this reference slope, as will be described presently.

After the microcomputer 80 has computed the reference slope, and next proceeds to question block 184 and inquires whether or not the pressure is greater than 19,800 psi. If the answer to this inquiry is yes, the microcomputer 80 next proceeds to block 185, and actuates the swage light while deactiving the hydraulic expansion unit 40. These are two reasons for deactivating the hydraulic expansion unit 40 upon a pressure reading of 19,800 psi. First, such a pressure is generally indicative of the formation of a joint between the sleeve 10 and tube 9, regardless of whether a pressure curve has intersected with the line function originating at 14,000 psi. Secondly, if the pressure is allowed to go much beyond 19,800 psi, there is a danger that the hydraulic expansion unit 40 will generate enough pressure to over-expand either the sleeve 10 or the tube 9.

Assuming that the pressure is below 19,800 psi, the microcomputer next proceeds to block 186, and calculates the slope of the empirical line function originating at 14,000 psi on the pressure curve. As previously described, the computer computes this slope by subtracting 7° from the reference slope computed in block 182. After performing the slope computation, the computer then projects this line function across the pressure/time graph, as indicated in FIG. 6.

The final question that the microcomputer 80 asks is whether or not the pressure curve which it plots every 1/10th of a second has intersected with the line function it has projected from the 14,000 psi point. If the answer to this inquiry is affirmative, the microcomputer 80 proceeds to block 189, activates the "swage" light of the indicator lamp circuit 90, and deactuates the expansion unit 40. If the answer to this inquiry is negative, it continues to sample the pressure as indicated in block 190, and ask whether or not the pressure is equal to or greater than 19,800 psi. Eventually (so long as there are no leaks), one or the other of these conditions will occur since the pressure in the sleeve 10 increases over time. In either case, the microcomputer 80 will finally actuate the swage light, and deactuate the hydraulic expansion unit 40.

What is claimed is:

1. An apparatus for reducing the clearance between a plastically deformable conduit and a structure surrounding a section of said conduit by plastically expanding said conduit, comprising:

(a) an expansive force means for generating a radially expansive pressure within said section of said conduit which increases as a function of time, whereby said conduit section is expanded into contact with said surrounding structure, and (b) a control means including a pressure sensing means for sensing the value of the pressure generated within the conduit, and a computer circuit having a timing circuit which is electrically connected to the pressure sensing means for detecting inflection points in the function defined by changes in pressure over time, and for computing the value of a final pressure within the conduit which will permanently deform the conduit into a selected proximity with respect to the surrounding structure in accordance with a function wherein the value of said final pressure is dependent upon the pressure within said conduit associated with one of said inflection points.

2. The apparatus according to claim 1, wherein said pressure sensing means is a pressure transducer.

3. The apparatus according to claim 1, wherein said control means further includes a low pass filter circuit electrically connected between said pressure sensing means and said computer circuit.

4. The apparatus according to claim 3, wherein said control means also includes a switching circuit electrically connected to said computer circuit and said expansive force means for deactuating said expansive force means after said expansive force means generates an expansive pressure equal in value to said final pressure.

5. The apparatus according to claim 1, wherein said expansive force generating means includes a pressurized fluid source capable of supplying fluid at variable pressures.

6. The apparatus according to claim 5, wherein said pressurized fluid source includes a mandrel fluidly connected to a hydraulic expansion unit.

7. The apparatus according to claim 1, wherein said conduit is formed from a metallic substance.

8. The apparatus according to claim 1, wherein the elasticity of said structure surrounding said conduit is substantially less than the elasticity of said conduit.

9. An apparatus for reducing the clearance between a metal conduit and the walls of a bore circumscribing said conduit, comprising:

(a) a fluid mandrel connected to a hydraulic expansion unit for applying a radially expansive force to said conduit which increases over time so that said conduit comes into contact with the walls of said bore;

(b) A control circuit electrically connected to said expansion unit for both detecting the fluid pressure at which said conduit contacts said walls of said bore, and for increasing the fluid pressure a percentage over the contact pressure which varies as a function of the value of the fluid pressure when said conduit contacts said walls of said bore before deactuating said expansion unit.

10. The apparatus according to claim 9, wherein said control circuit increases the fluid pressure between about 4 and 8 percent when the contact pressure is below about 8,000 psi.

11. The apparatus according to claim 9, wherein said control circuit increases the fluid pressure between about 8 and 12 percent when the contact pressure is above about 8,000 psi.

12. An apparatus for plastically expanding a plastically deformable conduit into permanent engagement against an elastically deformable structure which surrounds said conduit, comprising:

(a) an expansive force means for generating a radially expansive force within said section of said conduit which increases as a function of time, whereby said conduit is expanded into engagement with said surrounding structure, and (b) a control means operatively connected to said expansive force means for controlling said expansive force means so that the final value of the expansive force it generates is determined by the intersection of a line function orginating from a point in the vicinity of an inflection point in the force function indicative of deformation of said surrounding structure, and the function defined by value of the expansive force over time.

13. The apparatus of claim 12, wherein said expansive force means is a hydraulic expansion unit.

14. The apparatus of claim 13, wherein said control means includes a pressure sensing means in the form of a pressure transducer.

15. The apparatus of claim 14, wherein said control means includes a computer circuit for generating said line function.

16. The apparatus of claim 15, wherein said computer circuit decides from which point said line function will originate by periodically monitoring the second derivative of the function, and choosing the point which occurs just before the inflection point associated with the plastic deformation of said surrounding structure.

17. The apparatus of claim 16, wherein said computer generates the slope of said line function by computing the slope of the point on the function which occurs just before said inflection point, and subtracting between about 6° and 8° from the slope of said point.

18. The apparatus of claim 15, wherein said computer circuit decides from which point said line function will originate by choosing the point on the function where the pressure is about 14,000 psi.

19. The apparatus of claim 18, wherein said computer circuit decides the slope of said line by computing the slope of the pressure function at 14,000 psi, and subtracting about 7° from said slope.

20. The apparatus of claim 13, wherein said hydraulic expansion unit includes a fluid mandrel.

21. An apparatus for reducing the distance between an elastically and plastically deformable and work hardenable conduit and a surrounding structure by plastically expanding said conduit, comprising:

(a) an expansive pressure means for generating radially expansive pressure within the conduit which increases as a function of time, whereby said conduit is expanded into contact with said surrounding structure, and (b) a control means operatively connected to said expansive pressure means including a pressure transducer and a computer circuit with a timing means for (i) continuously monitoring the curve defined by the value of the pressure over time;

(ii) locating the last of at least two inflection points in said curve which is associated with contact between said conduit and said surrounding structure; and storing the value of the pressure associated with this inflection point;

(iii) computing the value of the maximum amount of radially expansive pressure which said expansive pressure means applies to said conduit in order to plastically deform said conduit a desired distance toward said surrounding structure, wherein said maximum value varies solely as a function of said stored value of the pressure in order to compensate for the work hardening which occurs in said conduit as it is plastically expanded, and (iv) applying said maximum amount of radially expansive pressure to said conduit through said expansive pressure means.

22. The apparatus defined in claim 21, wherein said control means further regulates the rate at which the expansive pressure means applies an increasing amount of expansive pressure to said conduit in order to avoid work-hardening said conduit when said expansive pressure means elastically expands said conduit prior to plastically expanding said conduit toward said surrounding structure.

23. The apparatus defined in claim 21, wherein said conduit is a metallic tube, said surrounding structure is a bore in a metallic plate, and said computer circuit of said control means computes the maximum value of the radially expansive pressure applied to the conduit by multiplying said stored pressure value by about 106% when said stored pressure value is less than about 8,000 psi, and multiplying said stored pressure value by 110% when said stored pressure value is greater than about 8,000 psi.

24. The apparatus defined in claim 21, wherein said conduit is a metallic sleeve, said surrounding structure is a metallic tube disposed around said sleeve, and said computer circuit of said control means computes the maximum value of the radially expansive pressure applied to the sleeve by projecting a line from the point just before an inflection point in the curve defined by the radially expansive pressure in the sleeve over time, wherein the slope of said line is about 7° lower than the slope of said pressure curve at said line projection point, and by deactuating said expansive pressure means when said pressure curve intersects with said line function.

25. The apparatus defined in claim 21, wherein said control means further includes a low pass filter circuit electrically connected between said pressure transducer and said computer circuit for preventing spurious high frequency signals from the pressure transducer from being transmitted to the computer circuit.

26. The apparatus defined in claim 21, wherein said control means deactuates said expansive pressure means when said pressure attains a selected value in order to prevent said conduit from being damaged.

27. An apparatus for reducing the clearance between a plastically deformable conduit and a structure surrounding a section of said conduit by plastically expanding said conduit, comprising (a) an expansive force means for generating a radially expansive pressure within said section of said conduit which increases as a function of time, whereby said conduit section is expanded into contact with said surrounding structure, and (b) a control means including a pressure-sensing means for sensing the value of the pressure generated within the conduit, and a computer circuit having a timing circuit which is electrically connected to the pressure-sensing means for detecting inflection points in the function defined by changes in pressure over time, noting the value and the slope of the pressure function in the vicinity of said inflection points, and for computing the value of a final pressure within the conduit which will permanently deform the conduit into a selected proximity with respect to the surrounding structure by adding an additional amount of pressure onto the noted pressure value, wherein the value of the additional pressure is a variable which is solely dependent on at least said noted pressure value in the vicinity of said inflection point.

* * * * *